US008262461B2

(12) United States Patent
Frick

(10) Patent No.: US 8,262,461 B2
(45) Date of Patent: Sep. 11, 2012

(54) CONFIGURATION FOR A HYBRID GAME

(75) Inventor: Michael D. Frick, Crawfordville, FL (US)

(73) Assignee: Integrated Group Assets Inc., Crawfordville, FL (US)

( * ) Notice: Subject to any disclaimer, the term of this patent is extended or adjusted under 35 U.S.C. 154(b) by 686 days.

(21) Appl. No.: 12/367,517

(22) Filed: Feb. 7, 2009

(65) Prior Publication Data

US 2010/0203950 A1 Aug. 12, 2010

(51) Int. Cl.
*A63F 9/24* (2006.01)

(52) U.S. Cl. ..... 463/22

(58) Field of Classification Search ..... None
See application file for complete search history.

(56) References Cited

U.S. PATENT DOCUMENTS

| | | | | |
|---|---|---|---|---|
| 5,613,679 | A * | 3/1997 | Casa et al. | 273/138.1 |
| 6,588,747 | B1 * | 7/2003 | Seelig | 273/138.1 |
| 6,830,514 | B2 * | 12/2004 | Meyer et al. | 463/17 |
| 7,347,776 | B2 * | 3/2008 | Wright | 463/17 |
| 7,635,303 | B2 * | 12/2009 | Wright | 463/17 |
| 7,819,738 | B2 * | 10/2010 | Bozeman et al. | 463/17 |
| 2002/0010022 | A1 * | 1/2002 | Vincent | 463/42 |
| 2002/0151342 | A1 * | 10/2002 | Tracy et al. | 463/16 |
| 2003/0114210 | A1 * | 6/2003 | Meyer et al. | 463/17 |
| 2005/0059465 | A1 * | 3/2005 | Bozeman | 463/18 |
| 2006/0100008 | A1 * | 5/2006 | Wright et al. | 463/17 |
| 2007/0026927 | A1 * | 2/2007 | Yaldoo et al. | 463/17 |
| 2007/0060244 | A1 * | 3/2007 | Yaldoo et al. | 463/16 |
| 2008/0015005 | A1 * | 1/2008 | Yaldoo et al. | 463/16 |
| 2008/0254851 | A1 * | 10/2008 | Wright et al. | 463/17 |
| 2008/0254853 | A1 * | 10/2008 | Wright et al. | 463/17 |
| 2009/0247256 | A1 * | 10/2009 | Barnes, II et al. | 463/17 |
| 2010/0144417 | A1 * | 6/2010 | Wright et al. | 463/17 |
| 2010/0160022 | A1 * | 6/2010 | Oram | 463/17 |

* cited by examiner

*Primary Examiner* — Ha Tran T Nguyen
*Assistant Examiner* — Vongsavanh Sengdara
(74) *Attorney, Agent, or Firm* — Samuel K. Simpson; Patent Ingenuity, P.C.

(57) ABSTRACT

A process generates, with a wager slip generation apparatus, a plurality of wager slips corresponding to a hybrid game such that each wager slip indicates a plurality of parallel matrices that each has a set of corresponding parallel matrix specific numbers. Further, the process generates, with a prize category display module, a display that indicates a spot prize that is won by a player having a predetermined number of matched parallel matrices. Each matched parallel matrix having a match between a spot quantity of numbers selected by the player from the set of corresponding parallel matrix specific numbers and a quantity of randomly drawn numbers from the set of corresponding parallel matrix specific numbers. In addition, the process receives, from each player, a selection of the spot quantity of numbers corresponding to each parallel matrix generated on one of the plurality of wager slips.

90 Claims, 15 Drawing Sheets

100

| 102 | 104 | 106 | 108 | 110 | 112 | 114 |
|---|---|---|---|---|---|---|
| A | n | y | W | o | r | d |
| 1 | 1 | 1 | 1 | 1 | 1 | 1 |
| 2 | 2 | 2 | 2 | 2 | 2 | 2 |
| 3 | 3 | 3 | 3 | 3 | 3 | 3 |
| 4 | 4 | 4 | 4 | 4 | 4 | 4 |
| 5 | 5 | 5 | 5 | 5 | 5 | 5 |
| 6 | 6 | 6 | 6 | 6 | 6 | 6 |
| 7 | 7 | 7 | 7 | 7 | 7 | 7 |
| 8 | 8 | 8 | 8 | 8 | 8 | 8 |
| 9 | 9 | 9 | 9 | 9 | 9 | 9 |
| 10 | 10 | 10 | 10 | 10 | 10 | 10 |
| 11 | 11 | 11 | 11 | 11 | 11 | 11 |

*Figure 1*

200

Hybrid Game Prize Structure

1 Spot 202

| Wager (204) | 6 columns (206) | 7 columns (208) |
|---|---|---|
| $10 (210) | $700,000 (214) | $7,000,000 (216) |
| $2 (212) | $100,000 (218) | $1,000,000 (220) |

2 Spot 220

| Wager (222) | 6 columns (224) | 7 columns (226) |
|---|---|---|
| $10 (228) | $5,000 (232) | $50,000 (234) |
| $2 (230) | $1,000 (236) | $10,000 (238) |

*Figure 2*

500

| 102 | 104 | 106 | 108 | 110 | 112 | 114 |
|---|---|---|---|---|---|---|
| A | n | y | W | o | r | d |
| 1 | 1 | 1 | 1 | 1 | 1 | 1 |
| 2 | 2 | 2 | 2 | 2 | 2 | 2 |
| 3 | 3 | 3 | 3 | 3 | 3 | 3 |
| 4 | 4 | 4 | 4 | 4 | 4 | 4 |
| 5 | 5 | 5 | 5 | 5 | 5 | 5 |
| 6 | 6 | 6 | 6 | 6 | 6 | 6 |
| 7 | 7 | 7 | 7 | 7 | 7 | 7 |
| 8 | 8 | 8 | 8 | 8 | 8 | 8 |
| 9 | 9 | 9 | 9 | 9 | 9 | 9 |
| 10 | 10 | 10 | 10 | 10 | 10 | 10 |
| 11 | 11 | 11 | 11 | 11 | 11 | 11 |

*Figure 5*

Expected Payout Table

1300

| Spot (1302) | $1 (1304) | $2 (1306) | Average Expected Payout (1308) |
|---|---|---|---|
| 1 Spot (1310) | 52% (1318) | 56% (1326) | 54% (1334) |
| 2 Spot (1312) | 48% (1320) | 52% (1328) | 50% (1336) |
| 3 Spot (1314) | 47% (1322) | 49% (1330) | 48% (1338) |
| 4 Spot (1316) | 47% (1324) | 49% (1332) | 48% (1340) |
| **Aggregate** | **48.50%** | **51.50%** | **50.00%** |

*Figure 13*

CONFIGURATION FOR A HYBRID GAME

BACKGROUND

1. Field

This disclosure generally relates to the field of gaming. More particularly, the disclosure relates to a hybrid game.

2. General Background

Over the past 15 years, many lotteries have experienced an erosion of net profit margins primarily as the result of sales shifts from higher margin product segments like numbers and lotto games to lower margin product segments like instant games. In 1992, for example, higher margin games made up approximately two thirds of total U.S. lottery sales and instant games represented less than a third of total U.S. lottery sales. By 2007, traditional higher margin games represented slightly more than one third of total U.S. lottery sales while instant sales had grown to over one half of total U.S. lottery sales. Typical instant games currently carry prize costs that are approximately thirty percent greater than corresponding traditional numbers, lotto and raffle games.

The result of this shift in sales to lower margin products has allowed sales to grow, but at the expense of net profit margins. Since 2005, several lotteries have suffered year-over-year declines in net profits despite having achieved record or near-record annual sales levels.

SUMMARY

In one aspect of the disclosure, a process is provided. The process prints, with a wage slip printer, a plurality of wager slips corresponding to a hybrid game such that each wager slip indicates a plurality of columns that each has an identical set of corresponding column specific numbers that are sequential. Further, the process generates, with a prize category display module, a display that indicates a first spot low prize and a first spot high prize. The first spot low prize is won by a player providing a first wager and having a predetermined number of first spot matched columns, each first spot matched column having a match between a first spot quantity of numbers selected by the player from the set of corresponding column specific numbers and a quantity of randomly drawn numbers from the set of corresponding column specific numbers. The first spot high prize is won by a player providing a second wager and having the predetermined number of first spot matched columns. The second wager is greater than the first wager. In addition, the process generates, with the prize category display module, a display that indicates a second spot low prize and a second spot high prize, the second spot low prize being won by a player providing a first wager and having a predetermined number of second spot matched columns. Each second spot matched column has a match between a second spot quantity of numbers selected by the player from the set of corresponding column specific numbers and a quantity of randomly drawn numbers from the set of corresponding column specific numbers, the second spot high prize being won by a player providing a second wager and having the predetermined number of second spot matched columns. The second wager is greater than the first wager. The second spot high prize is less than the first spot high prize. The process also receives, from each player, a selection of the spot quantity of numbers corresponding to each column generated on one of the plurality of wager slips. Further, the process prints, with a hybrid ticket generation apparatus, a plurality of hybrid game tickets that are each based on player selections of numbers indicated on the plurality of wager slips. In addition, the process performs, with a random selection apparatus, a random selection in each of the columns of at least one winning number from the set of corresponding column specific numbers. Finally, the process provides a prize distribution to a player having a winning hybrid game ticket based on (i) spot quantity selected by the player, (ii) wager provided by the player, and (iii) the predetermined number of matched columns.

In another aspect of the disclosure, a computer program product is provided. The computer program product includes a computer useable medium having a computer readable program. The computer readable program when executed on a computer causes the computer to print, with a wage slip printer, a plurality of wager slips corresponding to a hybrid game such that each wager slip indicates a plurality of columns that each has an identical set of corresponding column specific numbers that are sequential. Further, the computer readable program when executed on a computer causes the computer to generate, with a prize category display module, a display that indicates a first spot low prize and a first spot high prize. The first spot low prize is won by a player providing a first wager and having a predetermined number of first spot matched columns, each first spot matched column having a match between a first spot quantity of numbers selected by the player from the set of corresponding column specific numbers and a quantity of randomly drawn numbers from the set of corresponding column specific numbers. The first spot high prize is won by a player providing a second wager and having the predetermined number of first spot matched columns, the second wager being greater than the first wager. In addition, the computer readable program when executed on a computer causes the computer to generate, with the prize category display module, a display that indicates a second spot low prize and a second spot high prize. The second spot low prize is won by a player providing a first wager and having a predetermined number of second spot matched columns, each second spot matched column having a match between a second spot quantity of numbers selected by the player from the set of corresponding column specific numbers and a quantity of randomly drawn numbers from the set of corresponding column specific numbers, the second spot high prize being won by a player providing a second wager and having the predetermined number of second spot matched columns. The second wager is greater than the first wager. The second spot high prize is less than the first spot high prize. The computer readable program when executed on a computer also causes the computer to receive, from each player, a selection of the spot quantity of numbers corresponding to each column generated on one of the plurality of wager slips. Further, the computer readable program when executed on a computer causes the computer to print, with a hybrid ticket generation apparatus, a plurality of hybrid game tickets that are each based on player selections of numbers indicated on the plurality of wager slips. In addition, the computer readable program when executed on a computer causes the computer to perform, with a random selection apparatus, a random selection in each of the columns of at least one winning number from the set of corresponding column specific numbers. The computer readable program when executed on a computer also causes the computer to provide a prize distribution to a player having a winning hybrid game ticket based on (i) spot quantity selected by the player, (ii) wager provided by the player, and (iii) the predetermined number of matched columns.

In yet another aspect of the disclosure, a system is provided. The system includes a wage slip printer that prints a plurality of wager slips corresponding to a hybrid game such that each wager slip indicates a plurality of columns that each has an identical set of corresponding column specific numbers that are sequential. Further, the system includes a prize category display module that generates a display that indicates a first spot low prize, a first spot high prize, a second pot low prize, and a second spot high prize. The first spot low prize is won by a player providing a first wager and having a predetermined number of first spot matched columns, each first spot matched column having a match between a first spot quantity of numbers selected by the player from the set of corresponding column specific numbers and a quantity of randomly drawn numbers from the set of corresponding column specific numbers, the first spot high prize being won by a player providing a second wager and having the predetermined number of first spot matched columns, the second wager being greater than the first wager. The second spot low prize is won by a player providing a first wager and having a predetermined number of second spot matched columns, each second spot matched column having a match between a second spot quantity of numbers selected by the player from the set of corresponding column specific numbers and a quantity of randomly drawn numbers from the set of corresponding column specific numbers. The second spot high prize is won by a player providing a second wager and having the predetermined number of second spot matched columns. The second wager is greater than the first wager, the second spot high prize being less than the first spot high prize. The system also includes a reception module that receives, from each player, a selection of the spot quantity of numbers corresponding to each column generated on one of the plurality of wager slips. Further, the system includes a hybrid game ticket printer that prints a plurality of hybrid game tickets that are each based on player selections of numbers indicated on the plurality of wager slips. In addition, the system includes a random selection module that performs, with a random selection apparatus, a random selection in each of the columns of at least one winning number from the set of corresponding column specific numbers. The system also includes a prize distribution module that provides a prize distribution to a player having a winning hybrid game ticket based on (i) spot quantity selected by the player, (ii) wager provided by the player, and (iii) the predetermined number of matched columns.

In another aspect of the disclosure, a process is provided. The process generates, with a wager slip generation apparatus, a plurality of wager slips corresponding to a hybrid game such that each wager slip indicates a plurality of parallel matrices that each has a set of corresponding parallel matrix specific numbers. Further, the process generates, with a prize category display module, a display that indicates a first spot low prize and a first spot high prize, the first spot low prize being won by a player providing a first wager and having a predetermined number of first spot matched parallel matrices. Each first spot matched parallel matrix has a match between a first spot quantity of numbers selected by the player from the set of corresponding parallel matrix specific numbers and a quantity of randomly drawn numbers from the set of corresponding parallel matrix specific numbers. The first spot high prize is won by a player providing a second wager and having the predetermined number of first spot matched parallel matrices, the second wager being greater than the first wager. In addition, the process generates, with the prize category display module, a display that indicates a second spot low prize and a second spot high prize. The second spot low prize is won by a player providing the first wager and having a predetermined number of second spot matched parallel matrices. Each second spot matched column has a match between a second spot quantity of numbers selected by the player from the set of corresponding parallel matrix specific numbers and a quantity of randomly drawn numbers from the set of corresponding parallel matrix specific numbers. The second spot high prize is won by a player providing a second wager and having the predetermined number of second spot matched parallel matrices. The second wager is greater than the first wager, the second spot high prize being less than the first spot high prize. The process also receives, from each player, a selection of the spot quantity of numbers corresponding to each parallel matrix generated on one of the plurality of wager slips. In addition, the process prints, with a hybrid ticket generation apparatus, a plurality of hybrid game tickets that are each based on player selections of numbers indicated on the plurality of wager slips. The process also performs, with a random selection apparatus, a random selection in each of the parallel matrices of at least one winning number from the set of corresponding parallel matrix specific numbers. Further, the process provides a prize distribution to a player having a winning hybrid game ticket based on (i) spot quantity selected by the player, (ii) wager provided by the player, and (iii) the predetermined number of matched parallel matrices.

In yet another aspect of the disclosure, a computer program product is provided. The computer program product includes a computer useable medium having a computer readable program. The computer readable program when executed on a computer causes the computer to generate, with a wager slip generation apparatus, a plurality of wager slips corresponding to a hybrid game such that each wager slip indicates a plurality of parallel matrices that each has a set of corresponding parallel matrix specific numbers. Further, the computer readable program when executed on a computer causes the computer to generate, with a prize category display module, a display that indicates a first spot low prize and a first spot high prize. The first spot low prize is won by a player providing a first wager and having a predetermined number of first spot matched parallel matrices. Each first spot matched parallel matrix has a match between a first spot quantity of numbers selected by the player from the set of corresponding parallel matrix specific numbers and a quantity of randomly drawn numbers from the set of corresponding parallel matrix specific numbers. The first spot high prize is won by a player providing a second wager and having the predetermined number of first spot matched parallel matrices, the second wager being greater than the first wager. In addition, the computer readable program when executed on a computer causes the computer to generate, with the prize category display module, a display that indicates a second spot low prize and a second spot high prize. The second spot low prize is won by a player providing the first wager and having a predetermined number of second spot matched parallel matrices. Each second spot matched column has a match between a second spot quantity of numbers selected by the player from the set of corresponding parallel matrix specific numbers and a quantity of randomly drawn numbers from the set of corresponding parallel matrix specific numbers. The second spot high prize is won by a player providing a second wager and having the predetermined number of second spot matched parallel matrices. The second wager is greater than the first wager. The second spot high prize is less than the first spot high prize. The computer readable program when executed on a computer also causes the computer to receive, from each player, a selection of the spot quantity of numbers corresponding to each parallel matrix generated on one of the plurality of wager slips. Further, the computer readable program when executed on a computer causes the computer to print, with a hybrid ticket generation apparatus, a plurality of hybrid game tickets that are each based on player selections of numbers indicated on the plurality of wager slips. In addition, the computer readable program when executed on a computer causes the computer to perform, with a random selection apparatus, a random selection in each of the parallel matrices of at least one winning number from the set of corresponding parallel matrix specific numbers. The computer readable program when executed on a computer also causes the computer to provide a prize distribution to a player having a winning hybrid game ticket based on (i) spot quantity selected by the player, (ii) wager provided by the player, and (iii) the predetermined number of matched parallel matrices.

In another aspect of the disclosure, a system is provided. The system includes a wage slip generation apparatus that generates a plurality of wager slips corresponding to a hybrid game such that each wager slip indicates a plurality of parallel matrices that each has a set of corresponding parallel matrix specific numbers. Further, the system includes a prize category display module that generates a display that indicates a first spot low prize, a first spot high prize, a second spot low prize, and a second spot high prize. The first spot low prize is won by a player providing a first wager and having a predetermined number of first spot matched parallel matrices. Each first spot matched parallel matrix has a match between a first spot quantity of numbers selected by the player from the set of corresponding parallel matrix specific numbers and a quantity of randomly drawn numbers from the set of corresponding parallel matrix specific numbers. The first spot high prize is won by a player providing a second wager and having the predetermined number of first spot matched parallel matrices. The second wager is greater than the first wager. The second spot low prize is won by a player providing the first wager and having a predetermined number of second spot matched parallel matrices, each second spot matched column having a match between a second spot quantity of numbers selected by the player from the set of corresponding parallel matrix specific numbers and a quantity of randomly drawn numbers from the set of corresponding parallel matrix specific numbers. The second spot high prize is won by a player providing a second wager and having the predetermined number of second spot matched parallel matrices, the second wager being greater than the first wager. The second spot high prize is less than the first spot high prize. In addition, the system includes a reception module that receives, from a player, a selection of the spot quantity of numbers corresponding to each parallel matrix generated on one of the plurality of wager slips. The system also includes a hybrid game ticket printer that prints, with a hybrid ticket generation apparatus, a plurality of hybrid game tickets that are each based on player selections of numbers indicated on the plurality of wager slips. Further, the system includes a random selection apparatus that performs a random selection in each of the parallel matrices of at least one winning number from the set of corresponding parallel matrix specific numbers. The system also includes a prize distribution that provides a prize distribution to a player having a winning hybrid game ticket based on (i) spot quantity selected by the player, (ii) wager provided by the player, and (iii) the predetermined number of matched parallel matrices.

In yet another aspect of the disclosure, a process is provided. The process generates, with a wager slip generation apparatus, a plurality of wager slips corresponding to a hybrid game such that each wager slip indicates a plurality of parallel matrices that each has a set of corresponding parallel matrix specific numbers. Further, the process generates, with a prize category display module, a display that indicates a first spot prize that is won by a player providing a wager and having a predetermined number of first spot matched parallel matrices. Each first spot matched parallel matrix has a match between a first spot quantity of numbers selected by the player from the set of corresponding parallel matrix specific numbers and a quantity of randomly drawn numbers from the set of corresponding parallel matrix specific numbers. In addition, the process generates, with the prize category display module, a display that indicates a second spot prize that is won by a player providing the wager and having a predetermined number of second spot matched parallel matrices. Each second spot matched parallel matrix has a match between a second spot quantity of numbers selected by the player from the set of corresponding parallel matrix specific numbers and a quantity of randomly drawn numbers from the set of corresponding parallel matrix specific numbers. The second spot quantity is greater than the first spot quantity, the second spot quantity prize corresponding to a quantity of matched parallel matrices being less than the first spot quantity prize corresponding to the quantity of matched matrices. The process also receives, from a player, a selection of a quantity of numbers corresponding to each parallel matrix generated on one of the plurality of wager slips, the quantity of numbers being based on the first spot quantity or the second spot quantity. Further, the process prints, with a hybrid ticket generation apparatus, a plurality of hybrid game tickets that are each based on player selections of numbers indicated on the plurality of wager slips. In addition, the process performs, with a random selection apparatus, a random selection in each of the parallel matrices of at least one winning number from the set of corresponding parallel matrix specific numbers. The process also provides a prize distribution to a player having a winning hybrid game ticket based on (i) spot quantity selected by the player and (ii) the predetermined number of matched parallel matrices.

In another aspect of the disclosure, a computer program product is provided. The computer program product includes a computer useable medium having a computer readable program. The computer readable program when executed on a computer causes the computer to generate, with a wager slip generation apparatus, a plurality of wager slips corresponding to a hybrid game such that each wager slip indicates a plurality of parallel matrices that each has a set of corresponding parallel matrix specific numbers. Further, the computer readable program when executed on the computer causes the computer to generate, with a prize category display module, a display that indicates a first spot prize that is won by a player providing a wager and having a predetermined number of first spot matched parallel matrices. Each first spot matched parallel matrix has a match between a first spot quantity of numbers selected by the player from the set of corresponding parallel matrix specific numbers and a quantity of randomly drawn numbers from the set of corresponding parallel matrix specific numbers. In addition, the computer readable program when executed on the computer causes the computer to generate, with the prize category display module, a display that indicates a second spot prize that is won by a player providing the wager and having a predetermined number of second spot matched parallel matrices. Each second spot matched parallel matrix has a match between a second spot quantity of numbers elected by the player from the set of corresponding parallel matrix specific numbers and a quantity of randomly drawn numbers from the set of corresponding parallel matrix specific numbers. The second spot quantity is greater than the first spot quantity. The second spot quantity prize corresponding to a quantity of matched parallel matrices is less than the first spot quantity prize corresponding to the quantity of matched matrices. The computer readable program when executed on the computer also causes the computer to receive, from a player, a selection of a quantity of numbers corresponding to each parallel matrix generated on one of the plurality of wager slips, the quantity of numbers being based on the first spot quantity or the second spot quantity. Further, the computer readable program when executed on the computer causes the computer to print, with a hybrid ticket generation apparatus, a plurality of hybrid game tickets that are each based on player selections of numbers indicated on the plurality of wager slips. In addition, the computer readable program when executed on the computer causes the computer to perform, with a random selection apparatus, a random selection in each of the parallel matrices of at least one winning number from the set of corresponding parallel matrix specific numbers. The computer readable program when executed on the computer also causes the computer to provide a prize distribution to a player having a winning hybrid game ticket based on (i) spot quantity selected by the player and (ii) the predetermined number of matched parallel matrices.

In yet another aspect of the disclosure, a system is provided. The system has a wage slip generation apparatus that generates a plurality of wager slips corresponding to a hybrid game such that each wager slip indicates a plurality of parallel matrices that each has a set of corresponding parallel matrix specific numbers. Further, the system has a prize category display module that generates a display that indicates a first spot prize and a second spot prize. The first spot prize is won by a player providing a wager and having a predetermined number of first spot matched parallel matrices. Each first spot matched parallel matrix has a match between a first spot quantity of numbers selected by the player from the set of corresponding parallel matrix specific numbers and a quantity of randomly drawn numbers from the set of corresponding parallel matrix specific numbers. The second spot prize is won by a player providing the wager and having a predetermined number of second spot matched parallel matrices, each second spot matched parallel matrix having a match between a second spot quantity of numbers elected by the player from the set of corresponding parallel matrix specific numbers and a quantity of randomly drawn numbers from the set of corresponding parallel matrix specific numbers, the second spot quantity being greater than the first spot quantity. The second spot quantity prize corresponding to a quantity of matched parallel matrices being less than the first spot quantity prize corresponding to the quantity of matched matrices. In addition, the system has a reception module that receives, from a player, a selection of a quantity of numbers corresponding to each parallel matrix generated on one of the plurality of wager slips, the quantity of numbers being based on the first spot quantity or the second spot quantity. Further, the system has a hybrid game ticket printer that prints a plurality of hybrid game tickets that are each based on player selections of numbers indicated on the plurality of wager slips. In addition, the system has a random selection apparatus that performs a random selection in each of the parallel matrices of at least one winning number from the set of corresponding parallel matrix specific numbers. The system also has a prize distribution that provides a prize distribution to a player having a winning hybrid game ticket based on (i) spot quantity selected by the player and (ii) the predetermined number of matched parallel matrices.

In yet another aspect of the disclosure, a process is provided. The process generates, with a wager slip generation apparatus, a plurality of wager slips corresponding to a hybrid game such that each wager slip indicates a plurality of parallel matrices that each has a set of corresponding parallel matrix specific numbers. Further, the process generates, with a prize category display module, a display that indicates a spot prize that is won by a player having a predetermined number of matched parallel matrices. Each matched parallel matrix having a match between a spot quantity of numbers selected by the player from the set of corresponding parallel matrix specific numbers and a quantity of randomly drawn numbers from the set of corresponding parallel matrix specific numbers. In addition, the process receives, from each player, a selection of the spot quantity of numbers corresponding to each parallel matrix generated on one of the plurality of wager slips. The process also prints, with a hybrid ticket generation apparatus, a plurality of hybrid game tickets that are each based on player selections of numbers indicated on the plurality of wager slips. Further, the process performs, with a random selection apparatus, a random selection in each of the parallel matrices of at least one winning number from the set of corresponding parallel matrix specific numbers. In addition, the process provides a prize distribution to a player having a winning hybrid game ticket based on the predetermined number of matched parallel matrices.

In another aspect of the disclosure, a computer program product is provided. The computer program product includes a computer useable medium having a computer readable program. The computer readable program when executed on a computer causes the computer to generate, with a wager slip generation apparatus, a plurality of wager slips corresponding to a hybrid game such that each wager slip indicates a plurality of parallel matrices that each has a set of corresponding parallel matrix specific numbers. Further, the computer readable program when executed on a computer causes the computer to generate, with a prize category display module, a display that indicates a spot prize that is won by a player having a predetermined number of matched parallel matrices. Each matched parallel matrix has a match between a spot quantity of numbers selected by the player from the set of corresponding parallel matrix specific numbers and a quantity of randomly drawn numbers from the set of corresponding parallel matrix specific numbers. In addition, the computer readable program when executed on a computer causes the computer to receive, from each player, a selection of the spot quantity of numbers corresponding to each parallel matrix generated on one of the plurality of wager slips. The computer readable program when executed on a computer also causes the computer to print, with a hybrid ticket generation apparatus, a plurality of hybrid game tickets that are each based on player selections of numbers indicated on the plurality of wager slips. Further, the computer readable program when executed on a computer causes the computer to perform, with a random selection apparatus, a random selection in each of the parallel matrices of at least one winning number from the set of corresponding parallel matrix specific numbers. In addition, the computer readable program when executed on a computer causes the computer to provide a prize distribution to a player having a winning hybrid game ticket based on the predetermined number of matched parallel matrices.

In yet another aspect of the disclosure, a system is provided. The system has a wage slip generation apparatus that generates, with a wager slip generation apparatus, a plurality of wager slips corresponding to a hybrid game such that each wager slip indicates a plurality of parallel matrices that each has a set of corresponding parallel matrix specific numbers. Further, the system has a prize category display module that indicates a spot prize that is won by a player having a predetermined number of matched parallel matrices, each matched parallel matrix having a match between a spot quantity of numbers selected by the player from the set of corresponding parallel matrix specific numbers and a quantity of randomly drawn numbers from the set of corresponding parallel matrix specific numbers. In addition, the system has a reception module that receives, from each player, a selection of the spot quantity of numbers corresponding to each parallel matrix generated on one of the plurality of wager slips. The system also has a hybrid game ticket printer that prints a plurality of hybrid game tickets that are each based on player selections of numbers indicated on the plurality of wager slips. Further, the system has a random selection apparatus that performs a random selection in each of the parallel matrices of at least one winning number from the set of corresponding parallel matrix specific numbers. In addition, the system has a prize distribution module that provides a prize distribution to a player having a winning hybrid game ticket based on the predetermined number of matched parallel matrices.

BRIEF DESCRIPTION OF THE DRAWINGS

The above-mentioned features of the present disclosure will become more apparent with reference to the following description taken in conjunction with the accompanying drawings wherein like reference numerals denote like elements and in which:

FIG. 1 illustrates an example of a number selection portion of a wager slip for a hybrid game ticket.

FIG. 2 illustrates a hybrid game prize structure.

FIG. 5 illustrates an example of a number selection portion of a wager slip for a hybrid game ticket that provides visual indicia to distinguish between parallel matrices.

FIG. 13 illustrates an expected payout table.

DETAILED DESCRIPTION

Figure 3A:
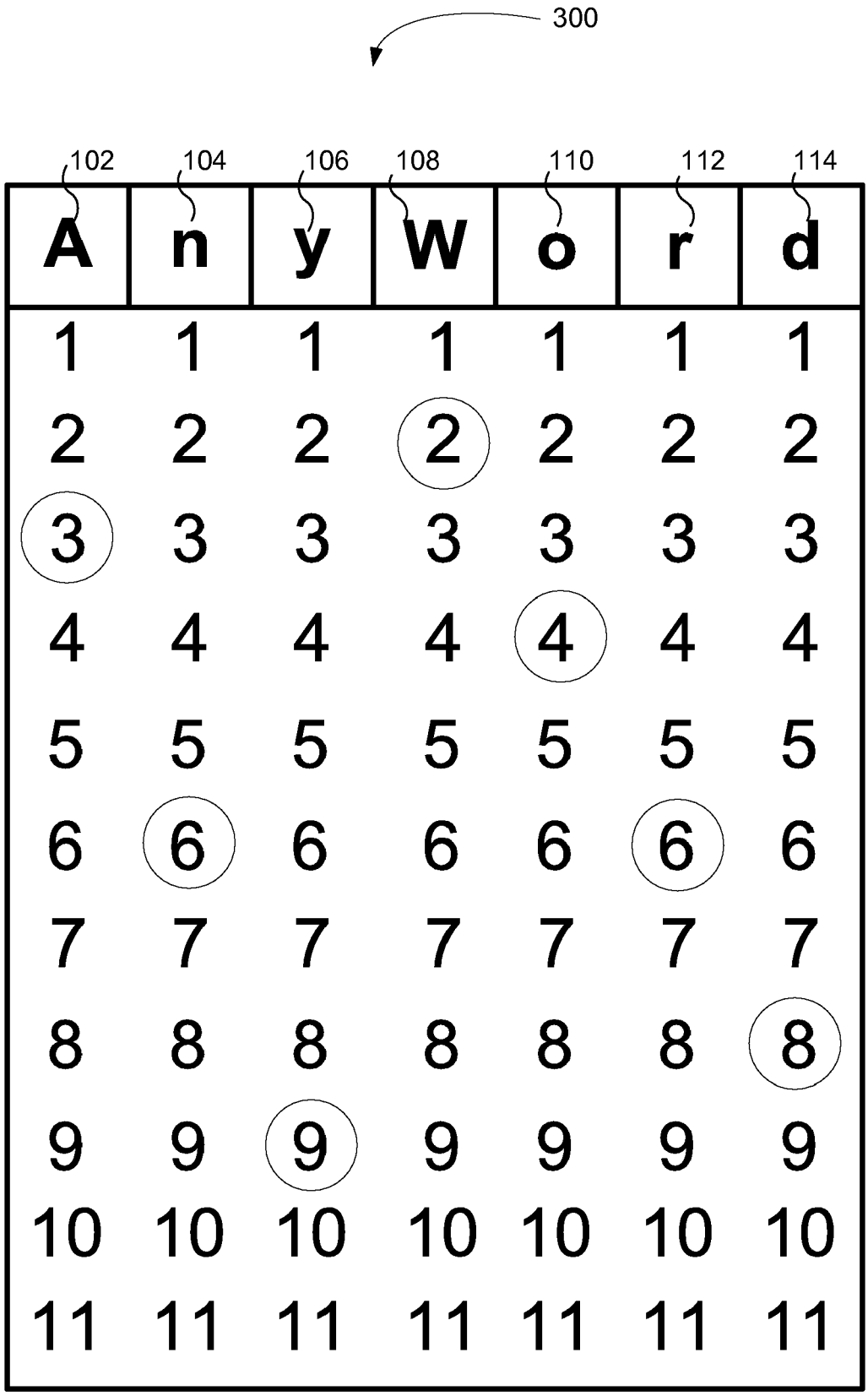
FIG. 3A provides an example of a number selection portion of a wager slip for a hybrid game ticket for which a player has selected a one spot.

A configuration that provides a hybrid game is disclosed. The hybrid game may be a unique combination of elements from a variety of games of chance. The configuration may be implemented to provide for a paper ticket, an electronic ticket, a virtual ticket, a game played on the Internet or any other wireless medium, a slot machine game, an online instant game, a scratch-off instant game, a peel-off instant game, an online drawing game, etc.

FIG. 1 illustrates an example of a number selection portion 100 of a wager slip for a hybrid game ticket. The number selection portion 100 of the wager slip for the hybrid game ticket has a plurality of parallel matrices. In one embodiment, the parallel matrices are columns. In another embodiment, the parallel matrices are rows. In yet another embodiment, the parallel matrices are diagonals. In yet another embodiment, a combination of columns, rows, and/or diagonals may be utilized. For illustrative purposes, the example of the number selection portion 100 of the wager slip for a hybrid game ticket in FIG. 1 has a plurality of seven columns. However, a different number of columns or any other parallel matrices may be utilized. In other words, any configuration of arrangement of parallel matrices may be utilized. If the matrices are columns, rows, or diagonals, the term vectors may be utilized to refer to such matrices.

In one embodiment, each of the columns has an identical set of sequential numbers. For example, each column in FIG. 1 is illustrated as having the numbers one through eleven. In another embodiment, the columns may have an identical set of non-sequential numbers. For example, each column in FIG. 1 may have the numbers one through ten and twelve. In yet another embodiment, the columns may have a distinct set of sequential numbers. For example, the first column may have the numbers one through eleven, the second column may have the numbers twelve through twenty two, etc. In another embodiment, the columns may have a distinct set of non-sequential numbers. For example, the first column may have the numbers one through ten and twelve, the second column may have the numbers thirteen through twenty two and twenty four, etc.

Further, the hybrid game ticket indicates a plurality of parallel matrix indicia that indicate a specific parallel matrix. For example, a first column indicia 102 indicates the letter "A," a second column indicia 104 indicates the letter "n," a third column indicia 106 indicates the letter "y," a fourth column indicia 108 indicates the letter "W," a fifth column indicia 110 indicates the letter "o," a sixth column indicia 112 indicates the letter "r," and a seventh column indicia 114 indicates the letter "d." The parallel matrix indicia provide an indication of the particular parallel matrix for which a player has selected a quantity of one or more player numbers. The player has to match a number to a specific parallel matrix for a winning number that is randomly selected, e.g., drawn, for that particular parallel matrix. For example, a player selecting player numbers for the first column that are drawn for the second column does not result in a winning hybrid game ticket.

In one embodiment, a match in a particular parallel matrix may increase the prize amount. For example, the fourth column having the fourth column indicia 108 of the letter "W" may have a doubler feature that doubles the prize amount won by a player. In one embodiment, the doubler is only applicable to prizes other than a jackpot or top prize.

In one embodiment, the player selects a spot quantity for the player numbers that are selected for each parallel matrix. The spot quantity is less than the total number of numbers in the parallel matrix. For example, the player may select a one spot such that the player can select one number for each parallel matrix. A player only has one chance to match the number for that particular parallel matrix. As another example, a player may select a two spot such that the player can select two numbers for each parallel matrix. Accordingly, for each parallel matrix, the player has two chances to match the one number that is drawn for the particular parallel matrix. As a result, the player will be able to win a larger prize for a lesser spot. In other words, a player has only once chance to obtain a match for a particular parallel matrix with a selection of a one spot as opposed to two chances to obtain a match for a particular with a two spot. Therefore, a player wins a larger prize for a smaller spot, which provides a smaller chance of winning.

In one embodiment, the choice of spot quantities is consistent throughout all of the parallel matrices. For example, the player may have the ability to choose between a one spot and a two spot for each parallel matrix. In another embodiment, the choice of spot quantities may be different amongst the parallel matrices. For example, the player may be able to choose between the first spot quantity and the second spot quantity in the first column, but may have to select the first spot quantity for the remaining six columns.

In another embodiment, the parallel matrices may be reels on a slot machine. The arrangement of parallel matrices may be displayed in a grid on the slot machine. Further, an electronic version, e.g., an Internet game that is played through a computing device, may also display an electronic version or the like of reels.

FIG. 2 illustrates a hybrid game prize structure 200. The hybrid game prize structure 200 includes a one spot prize structure 202 and a two spot prize structure 220. These prize structures are provided as examples. Many other spot prize structures may be provided within a given game, e.g., a three spot prize structure, a four spot prize structure, and a five spot prize structure. The one spot prize structure 202 includes a wager field 204, a six columns field 206, and a seven columns field 208. If the player selects a one spot, i.e., only one number for each parallel matrix, and provides a first wager 210, e.g., ten dollars, the player may win a six column one spot prize 214, e.g., seven hundred thousand dollars. If the player selects a one spot and provides the first wager 210, the player may win a seven column one spot prize 214, e.g., seven million dollars. The player may alternatively provide a lower wager such as a second wager 212 to win a six column one spot prize 218, e.g., one hundred thousand dollars, or a seven column one spot prize 220, e.g., one million dollars.

The two spot prize structure 220 includes a wager field 222, a six columns field 224, and a seven columns field 226. If the player selects a two spot, i.e., two numbers for each parallel matrix in a matrix, and provides a first wager 228, e.g., ten dollars, the player may win a six column two spot prize 232, e.g., five thousand dollars. If the player selects a two spot and provides the first wager 228, the player may win a seven column two spot prize 214, e.g., fifty thousand dollars. The player may alternatively provide a lower wager such as a second wager 230 to win a six column two spot prize 236, e.g., one thousand dollars, or a seven columns two spot prize 238, e.g., ten thousand dollars.

For illustrative purposes, six column and seven column prizes are provided. However, any number of columns less than or equal to the total number of columns may have corresponding prizes. Further, the same occurs with any parallel matrix configuration utilized. In one embodiment, a combination of different types of parallel matrices, e.g., columns, rows, and/or diagonals may have corresponding prizes.

For illustrative purposes, two wagers are provided. However, more than two wagers may be utilized. The player receives a higher prize for providing a higher wager. Alternatively, any of the configurations provided herein may be utilized with a single price point.

FIG. 3A provides an example of a number selection portion 300 of a wager slip for a hybrid game ticket for which a player has selected a one spot. As illustrated, the player has selected the number three in the first column, the number six in the second column, the number nine in the third column, the number two in the fourth column, the number four in the fifth column, the number six in the sixth column, and the number eight in the seventh column. The selection of the numbers may be performed by shading, drawing a circle, drawing a box, or the like.

Figure 3B:
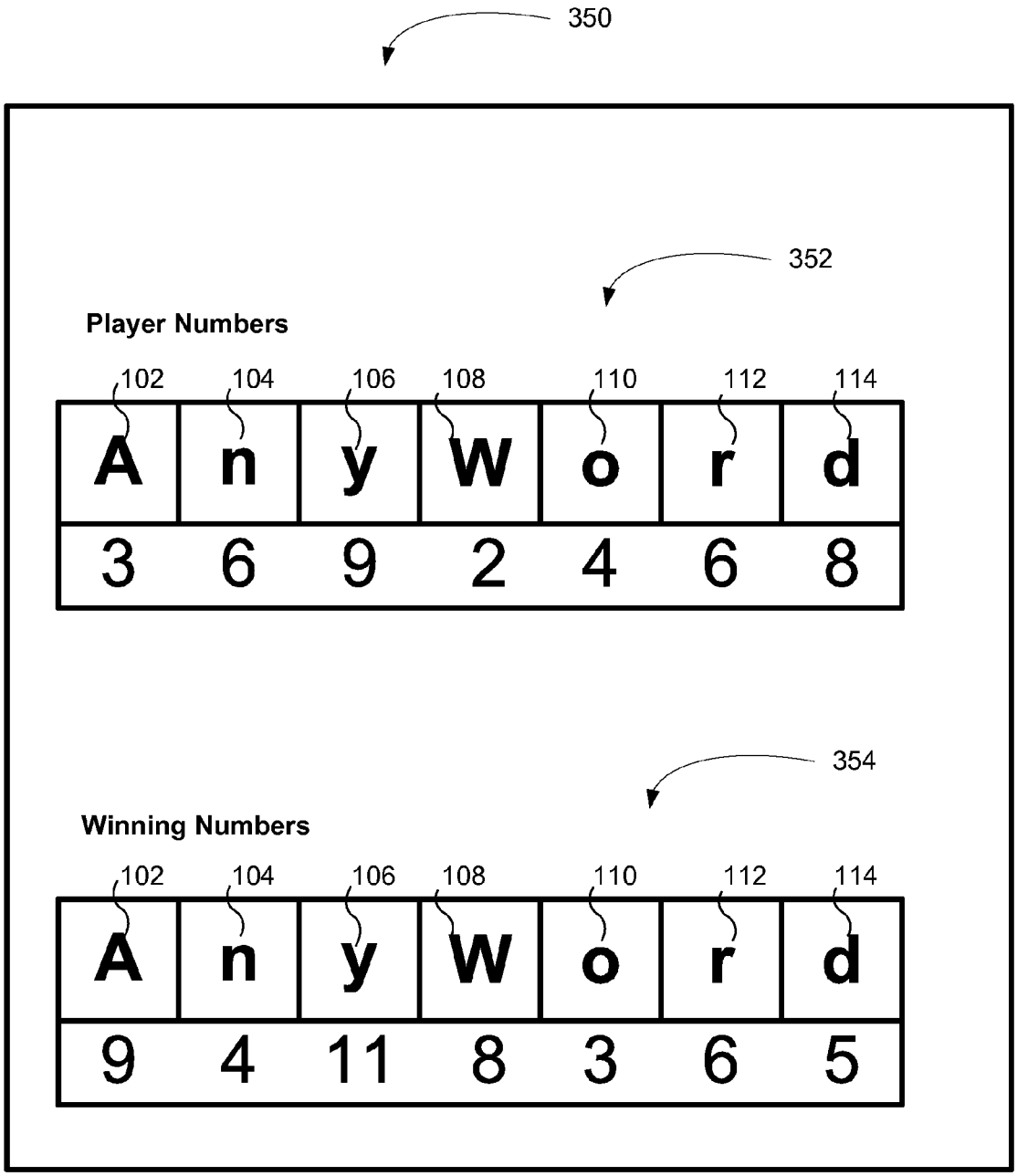
FIG. 3B illustrates an example of a "one spot" hybrid game ticket for an instant hybrid game.

FIG. 3B illustrates an example of a hybrid game ticket 350 for an instant hybrid game. The hybrid game ticket 350 includes a set of player numbers 352 and a set of winning numbers 354. Each of the winning numbers is randomly drawn for each column in the hybrid game for which the hybrid game ticket 350 was purchased. The set of player numbers 352 includes the numbers selected from the number selection portion 300 of the wager slip illustrated in FIG. 3A. As illustrated in FIG. 3B, the randomly drawn numbers are the number nine in the first column, the number four in the second column, the number eleven in the third column, the number eight in the fourth column, the number three in the fifth column, the number six in the sixth column, and the number five in the seventh column. Accordingly, the player has matched only one number, i.e., the number six in the sixth column. The instant version of the hybrid game is provided for illustrative purposes only. A draw-based version of the hybrid game may be utilized. In a draw-based version of the hybrid game, the randomly drawn numbers cannot be printed on the ticket because the randomly drawn numbers are not known until a drawing occurs after the ticket is printed. Accordingly, the player numbers without the randomly drawn numbers are printed on a draw-based version of the hybrid game.

Figure 4A:
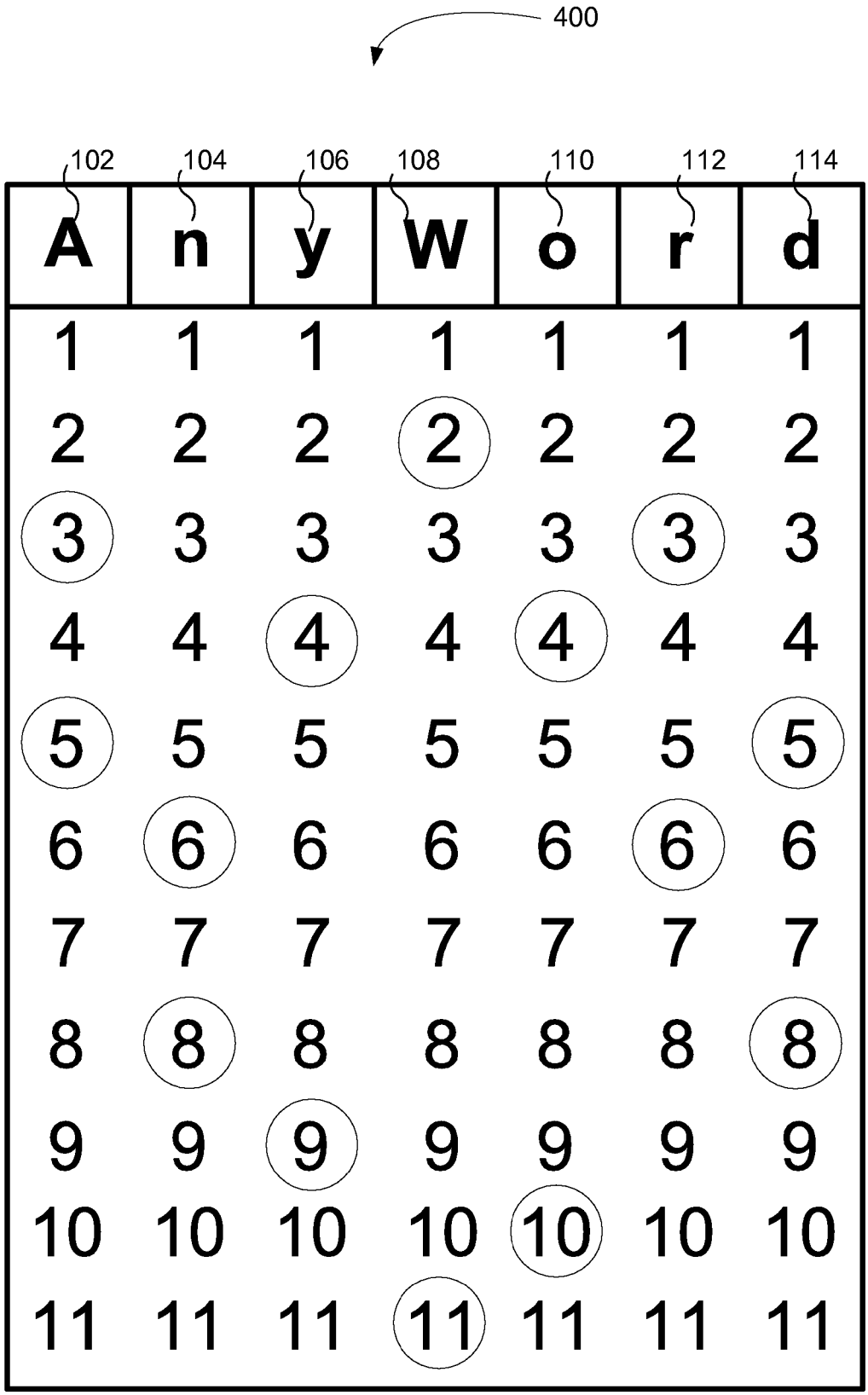
FIG. 4A provides an example an example of a number selection portion of a wager slip for a hybrid game ticket for which a player has selected a two spot.

FIG. 4A provides an example an example of a number selection portion 400 of a wager slip for a hybrid game ticket for which a player has selected a two spot. As illustrated, the player has selected the numbers three and five in the first column, the numbers six and eight in the second column, the numbers four and nine in the third column, the numbers two and eleven in the fourth column, the numbers four and ten in the fifth column, the numbers three and six in the sixth column, and the numbers five and eight in the seventh column. The set of winning numbers 354 illustrated in FIG. 3B is also applicable to the two spot. The player with the two simply has more chances to match each number drawn for a particular column, but wins a lesser prize for the same number of columns matched because of having greater chances of winning. The player with the hybrid game ticket 400 matches two columns because the number drawn for the sixth column, e.g., six, is included within the two numbers selected by the player for the sixth column, e.g., three and six, and the number drawn for the seventh column, e.g., five, is included within the two numbers selected by the player for the seventh column, e.g., five and eight.

Figure 4B:
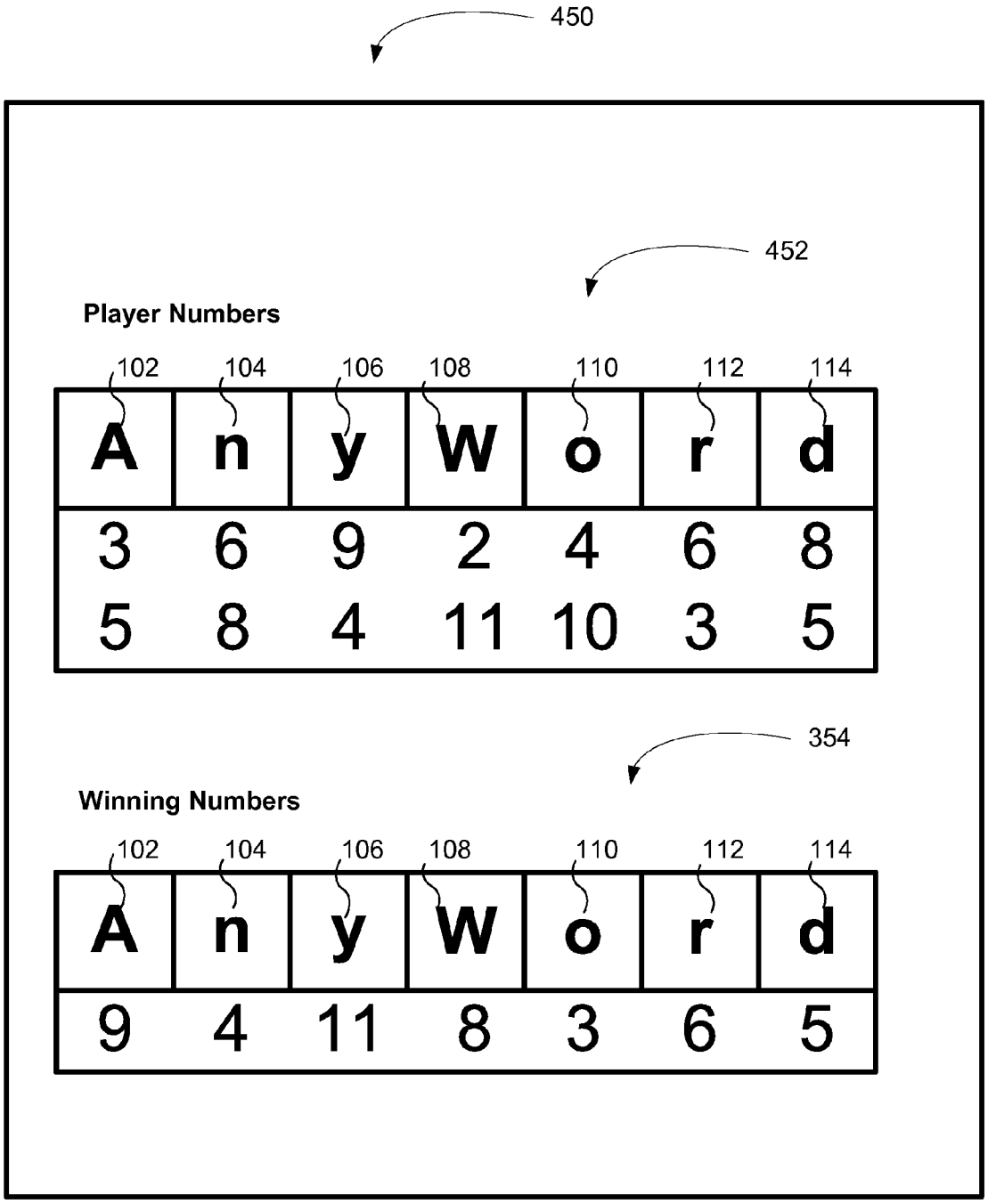
FIG. 4B illustrates an example of a "two spot" hybrid game ticket for an instant hybrid game.

FIG. 4B illustrates an example of a hybrid game ticket 450 for an instant hybrid game. The hybrid game ticket 450 includes a set of player numbers 452 and the set of winning numbers 354. The set of winning numbers 354 is the same set of winning numbers illustrated in FIG. 3B as the set of winning numbers is applicable to both the one spot tickets and the two spot tickets. The set of player numbers 452 includes the numbers selected from the number selection portion 400 of the wager slip illustrated in FIG. 4A. As illustrated in FIG. 4B, the randomly drawn numbers are the number nine in the first column, the number four in the second column, the number eleven in the third column, the number eight in the fourth column, the number three in the fifth column, the number six in the sixth column, and the number five in the seventh column. Accordingly, the player has matched only one number, i.e., the number six in the sixth column. The instant version of the hybrid game is provided for illustrative purposes only. A draw-based version of the hybrid game may be utilized.

In one embodiment, the number of parallel matrices matched is a factor for determining the amount of the prize. For instance, a predetermined number of parallel matrices may have to be matched to win a type of prize. As an example, six of seven columns may have to be matched to win a top prize whereas five of seven columns being matched, four of seven columns being matched, or three of seven columns being matched may provide a variety of secondary prizes. In one embodiment, the parallel matrices may be matched non-consecutively to win a prize. For example, matching column one and columns three through seven may provide the same top prize of a six of seven column match as matching columns one through six. Accordingly, the parallel matrices in this configuration are dependent on one another for the purpose of prize determination. However, the parallel matrices in this determination are not dependent on one another for the purpose of winning number selection as separate random number selection occurs for each parallel matrix.

In another embodiment, the parallel matrices have to be matched in a consecutive or ordered fashion to win a prize. For example, six consecutive columns such as columns one through six or columns two through seven out of seven columns may need to be matched to win the top prize.

In one embodiment, the parallel matrices each have identical sets of numbers in quantity. For example, the parallel matrices may each have eleven numbers. Those eleven numbers may identical for all of the parallel matrices, distinct for all of the parallel matrices, or distinct for only some of the parallel matrices. In yet another embodiment, at least some of the parallel matrices may have distinct sets of numbers in quantity. For example, the first column may have seven numbers, the second column may have eight numbers, the third column may have nine numbers, the fourth column may have ten numbers, the fifth column may have eleven numbers, and the fifth column may have twelve numbers. As another example, the first two columns may have seven numbers and the last three columns may have twelve numbers. In one configuration, the prizes may be awarded based on the difficulty of winning a specific column. For example, a player that has matched a column with twelve numbers may receive a higher prize total prize than having matched a column with only seven numbers, which is less difficult. Accordingly, the prizes may be a function of specific columns. The prize determination may be tabulated by adding the total number of columns matched and determining the type of match that occurred based on the quantity of numbers in the columns that are matched.

In another embodiment, the spot quantity is not selected by the player. For example, the gaming entity, e.g., a lottery, may have a predetermined quantity such as a one spot that the player needs to choose in quantity. The term predetermined as described herein may be utilized interchangeably with the term pre-established. The player selects the actual number, but can only select one number for each parallel matrix. In another embodiment, the player may have the opportunity to select between spot quantities for some parallel matrices and have a predetermined spot quantity for one or more other parallel matrices. For example, the player may be able to select between a one spot and a two spot for a first column, but may have to select a one spot for the second through fifth columns.

In an alternative embodiment, more than one number may be drawn for each parallel matrix. In this configuration, prizes may be larger for having more numbers matched in each parallel matrix. For example, a higher prize may be provided for matching two of two numbers drawn in a specific parallel matrix than one of two numbers drawn in that specific parallel matrix. However, a higher spot may result in a lesser prize. For example, matching two of two numbers for a three spot may result in a lesser prize than matching two of two numbers for a two spot. In one embodiment, the player may have the ability to determine not only the spot, but also the number of numbers that are randomly drawn. For example, a slot implementation of this configuration may allow the player to select both the spot quantity and the quantity of randomly drawn numbers for each parallel matrix. This implementation is not limited to slot machines and may be implemented in an Internet game, paper game, instant game, scratch-off game, etc.

FIG. 5 illustrates an example of an example of a number selection portion 500 of a wager slip for a hybrid game ticket that provides visual indicia to distinguish between parallel matrices. For example, lines may be utilized to distinguish between columns.

Figure 6:
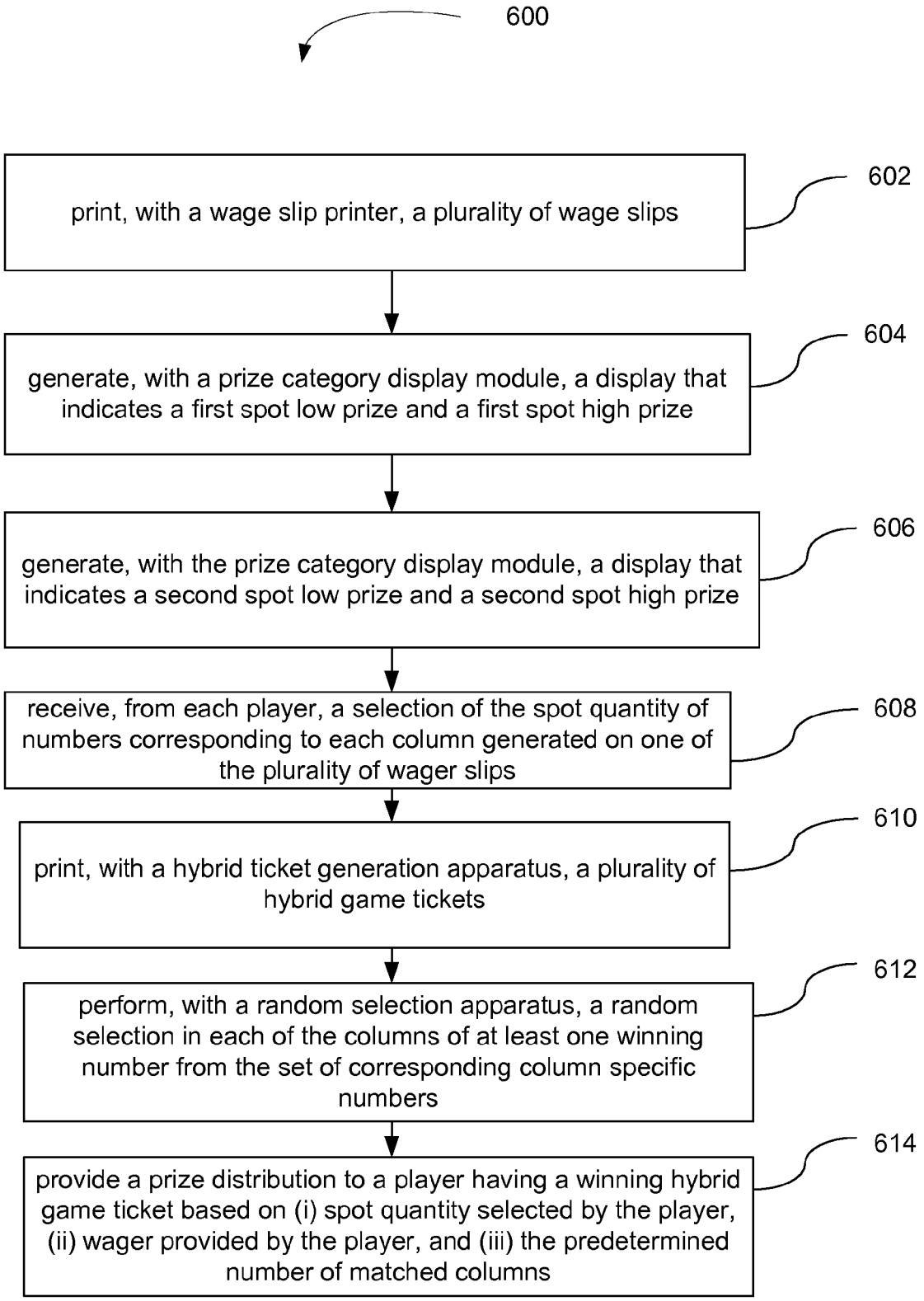
FIG. 6 illustrates a process that may be utilized to provide hybrid game tickets.

FIG. 6 illustrates a process 600 that may be utilized to provide hybrid game tickets. At a process block 602, the process 600 prints, with a wage slip printer, a plurality of wager slips corresponding to a hybrid game such that each wager slip indicates a plurality of columns that each has an identical set of corresponding column specific numbers that are sequential. Further, at a process block 604, the process 600 generates, with a prize category display module, a display that indicates a first spot low prize and a first spot high prize. The first spot low prize is won by a player providing a first wager and having a predetermined number of first spot matched columns, each first spot matched column having a match between a first spot quantity of numbers selected by the player from the set of corresponding column specific numbers and a quantity of randomly drawn numbers from the set of corresponding column specific numbers. The first spot high prize is won by a player providing a second wager and having the predetermined number of first spot matched columns. The second wager is greater than the first wager. In addition, at a process block 606, the process 600 generates, with the prize category display module, a display that indicates a second spot low prize and a second spot high prize, the second spot low prize being won by a player providing a first wager and having a predetermined number of second spot matched columns. Each second spot matched column has a match between a second spot quantity of numbers selected by the player from the set of corresponding column specific numbers and a quantity of randomly drawn numbers from the set of corresponding column specific numbers, the second spot high prize being won by a player providing a second wager and having the predetermined number of second spot matched columns. The second wager is greater than the first wager. The second spot high prize is less than the first spot high prize. At a process block 608, the process 600 also receives, from each player, a selection of the spot quantity of numbers corresponding to each column generated on one of the plurality of wager slips. Further, at a process block 610, the process 600 prints, with a hybrid ticket generation apparatus, a plurality of hybrid game tickets that are each based on player selections of numbers indicated on the plurality of wager slips. In addition, at a process block 612, the process 600 performs, with a random selection apparatus, a random selection in each of the columns of at least one winning number from the set of corresponding column specific numbers. Finally, at a process block 614, the process 600 provides a prize distribution to a player having a winning hybrid game ticket based on (i) spot quantity selected by the player, (ii) wager provided by the player, and (iii) the predetermined number of matched columns.

Figure 7:
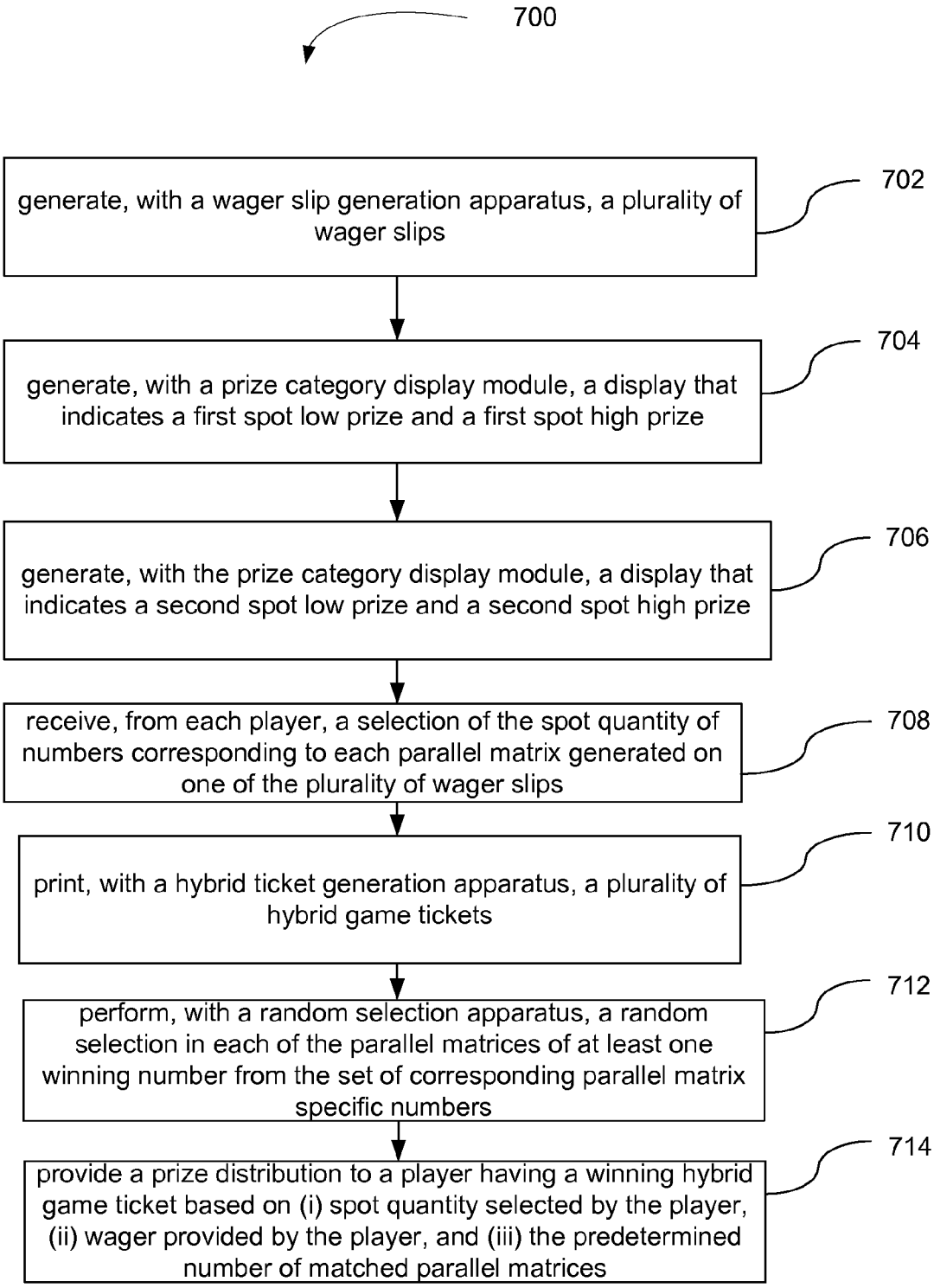
FIG. 7 illustrates another process that may be utilized to provide hybrid game tickets.

FIG. 7 illustrates another process 700 that may be utilized to provide hybrid game tickets. At a process block 702, the process 700 generates, with a wager slip generation apparatus, a plurality of wager slips corresponding to a hybrid game such that each wager slip indicates a plurality of parallel matrices that each has a set of corresponding parallel matrix specific numbers. Further, at a process block 704, the process 700 generates, with a prize category display module, a display that indicates a first spot low prize and a first spot high prize, the first spot low prize being won by a player providing a first wager and having a predetermined number of first spot matched parallel matrices. Each first spot matched parallel matrix has a match between a first spot quantity of numbers selected by the player from the set of corresponding parallel matrix specific numbers and a quantity of randomly drawn numbers from the set of corresponding parallel matrix specific numbers. The first spot high prize is won by a player providing a second wager and having the predetermined number of first spot matched parallel matrices, the second wager being greater than the first wager. In addition, at a process block 706, the process 700 generates, with the prize category display module, a display that indicates a second spot low prize and a second spot high prize. The second spot low prize is won by a player providing the first wager and having a predetermined number of second spot matched parallel matrices. Each second spot matched column has a match between a second spot quantity of numbers selected by the player from the set of corresponding parallel matrix specific numbers and a quantity of randomly drawn numbers from the set of corresponding parallel matrix specific numbers. The second spot high prize is won by a player providing a second wager and having the predetermined number of second spot matched parallel matrices. The second wager is greater than the first wager, the second spot high prize being less than the first spot high prize. At a process block 708, the process 700 also receives, from each player, a selection of the spot quantity of numbers corresponding to each parallel matrix generated on one of the plurality of wager slips. In addition, at a process block 710, the process 700 prints, with a hybrid ticket generation apparatus, a plurality of hybrid game tickets that are each based on player selections of numbers indicated on the plurality of wager slips. At a process block 712, the process 700 also performs, with a random selection apparatus, a random selection in each of the parallel matrices of at least one winning number from the set of corresponding parallel matrix specific numbers. Further, at a process block 714, the process 700 provides a prize distribution to a player having a winning hybrid game ticket based on (i) spot quantity selected by the player, (ii) wager provided by the player, and (iii) the predetermined number of matched parallel matrices.

The term number of parallel matrices having matches as described herein is intended to include the number zero. In other words, a prize may be awarded for having matched zero columns. For a match of zero columns to occur, the spots selected would have to be distinct, either partially or fully, from the numbers drawn per column.

Figure 8:
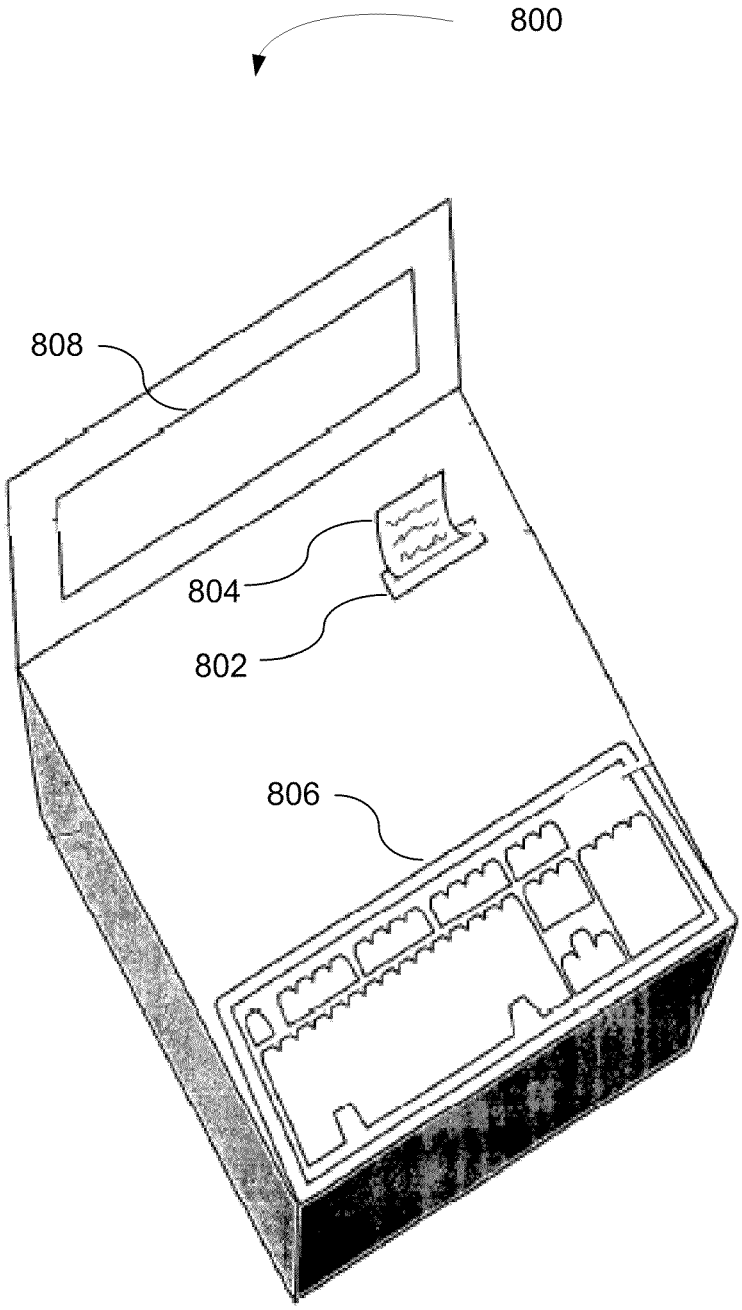
FIG. 8 illustrates a hybrid game ticket dispensing machine.

FIG. 8 illustrates a hybrid game ticket dispensing machine 800. An input console 806 may receive data from the player, a lottery operator, or lottery vendor of a selection of a spot quantity and numbers for each parallel matrix. Further, a ticket printer 802 prints the hybrid game ticket 804. The display console 808 may display information regarding the hybrid game prize structure and/or payment information. A payment receptor may also be utilized with the hybrid game ticket dispensing machine 800 to receive payment for play of the hybrid game.

Figure 9:
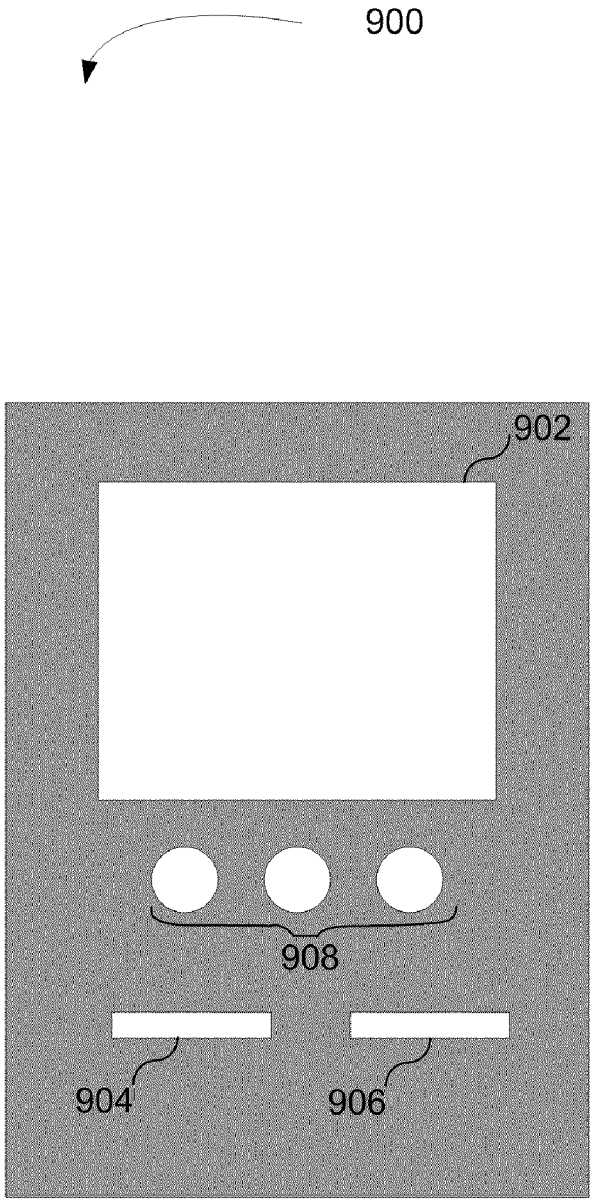
FIG. 9 illustrates a hybrid game electronic apparatus that may be utilize to play an electronic version of the hybrid game.

FIG. 9 illustrates a hybrid game electronic apparatus 900 that may be utilize to play an electronic version of the hybrid game. An input console 908 may receive data from the player, a lottery operator, or lottery vendor of a selection of a spot quantity and numbers for each parallel matrix. Further, a ticket printer 904 prints the hybrid game ticket. A payment receptor 904 may receive payment for play of the hybrid game. The display console 902 may display information regarding the hybrid game prize structure and/or payment information.

In one embodiment, the ticket printer 904 is not utilized because the electronic version of the hybrid game may be paperless. For example, a virtual ticket may be displayed on the display console 902 for Internet-based play, mobile devices, interactive television, or the like. Further, the display console 902 may be a monitor screen for a monitor game.

Figure 10:
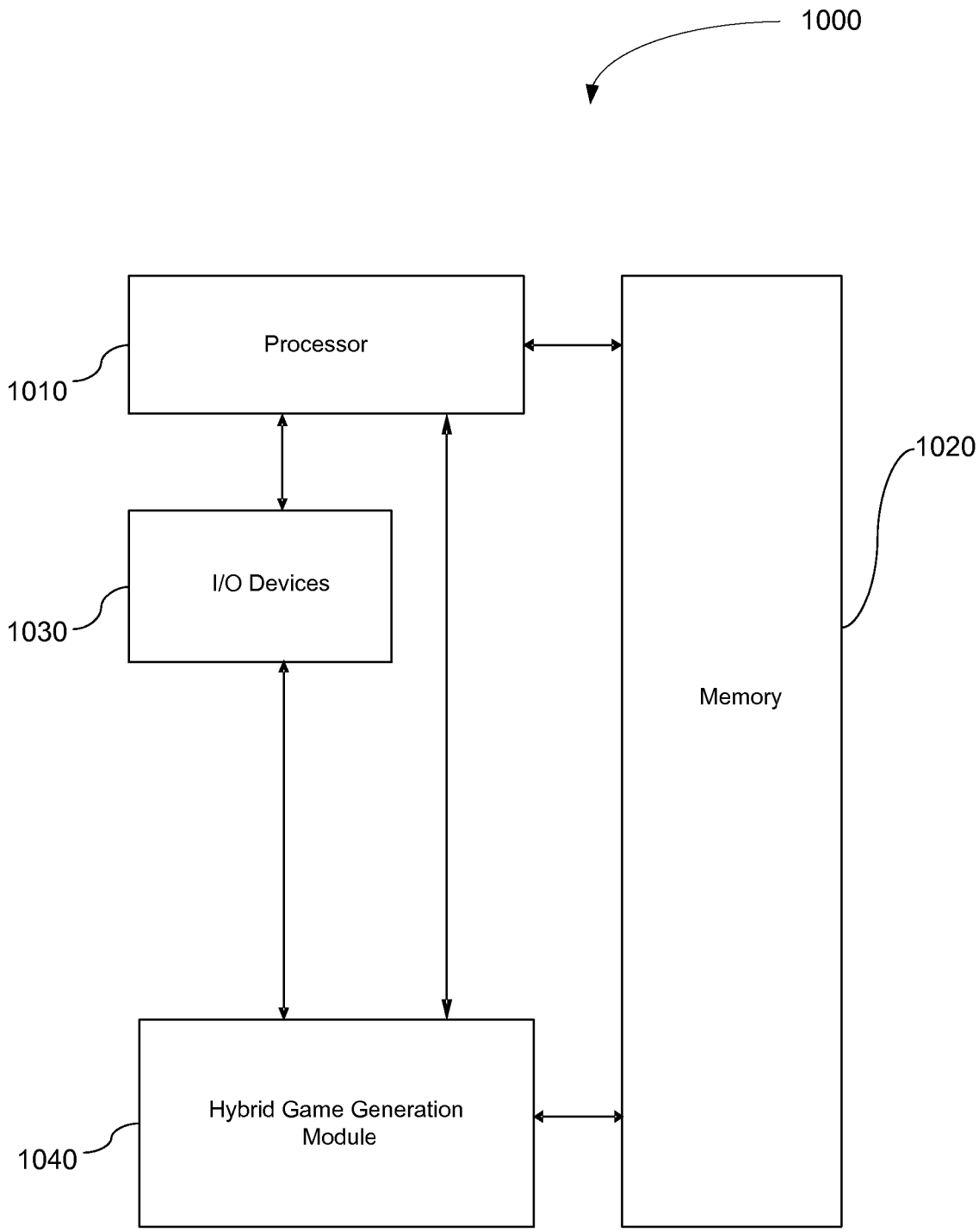
FIG. 10 illustrates a block diagram of a station or system that provides hybrid game tickets.

FIG. 10 illustrates a block diagram of a station or system 1000 that provides hybrid game tickets. In one embodiment, the station or system 1000 is implemented utilizing a general purpose computer or any other hardware equivalents. Thus, the station or system 1000 comprises a processor 1010, a memory 1020, e.g., random access memory ("RAM") and/or read only memory (ROM), a hybrid game generation module 1040, and various input/output devices 1030, (e.g., audio/video outputs and audio/video inputs, storage devices, including but not limited to, a tape drive, a floppy drive, a hard disk drive or a compact disk drive, a receiver, a transmitter, a speaker, a display, an image capturing sensor, e.g., those used in a digital still camera or digital video camera, a clock, an output port, a user input device (such as a keyboard, a keypad, a mouse, and the like, or a microphone for capturing speech commands)).

It should be understood that the hybrid game generation module 1040 may be implemented as one or more physical devices that are coupled to the processor 1010. For example, the hybrid game generation module 1040 may include a plurality of modules. Alternatively, the hybrid game generation module 1040 may be represented by one or more software applications (or even a combination of software and hardware, e.g., using application specific integrated circuits (ASIC)), where the software is loaded from a storage medium, (e.g., a magnetic or optical drive, diskette, or non-volatile memory) and operated by the processor in the memory 1020 of the computer. As such, the hybrid game generation module 1040 (including associated data structures) of the present disclosure may be stored on a computer readable medium, e.g., RAM memory, magnetic or optical drive or diskette and the like.

Figure 11:
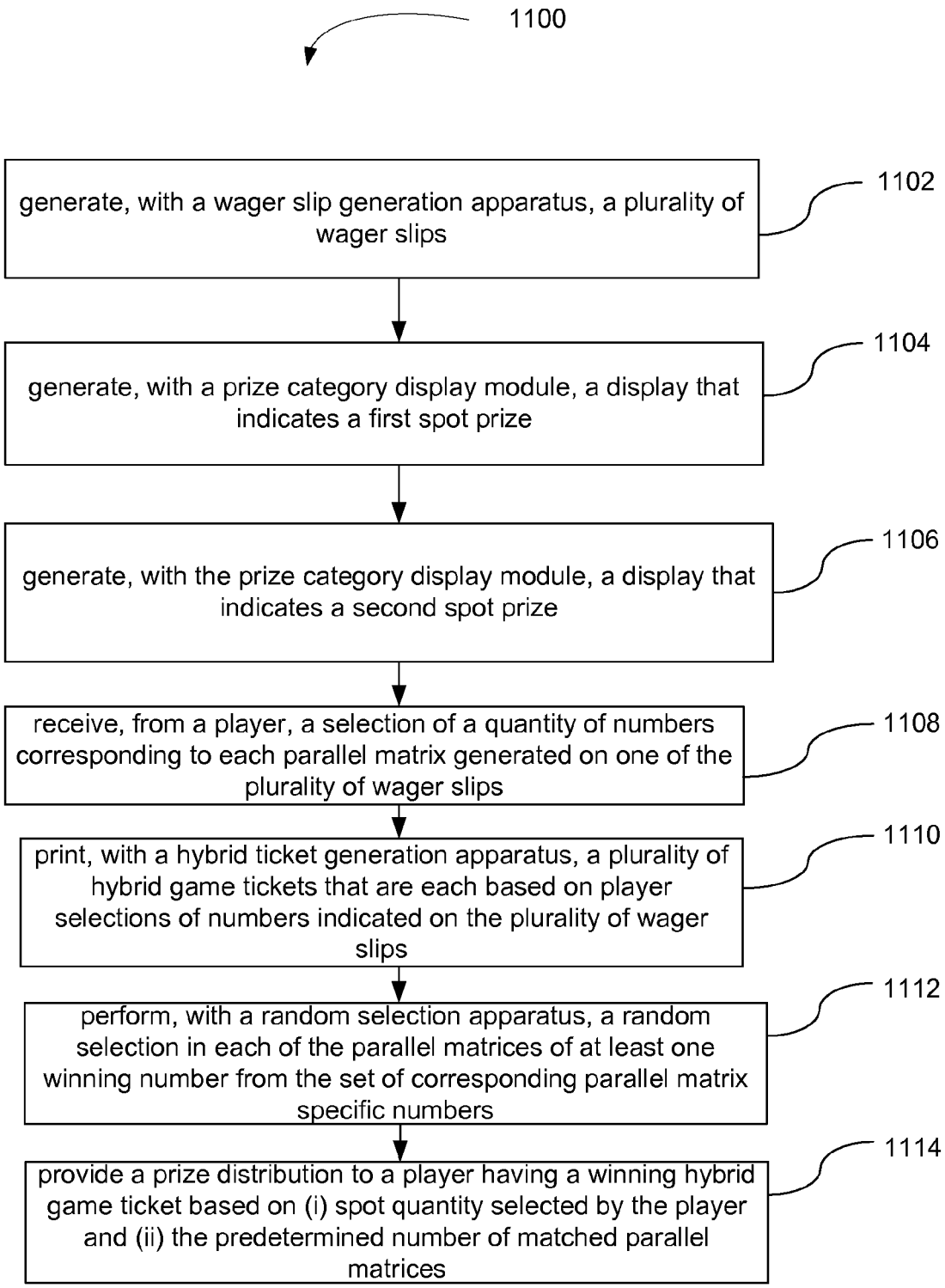
FIG. 11 illustrates another process that may be utilized to generate hybrid game tickets.

FIG. 11 illustrates another process 1100 that may be utilized to generate hybrid game tickets. At a process block 1102, the process 1100 generates, generates, with a wager slip generation apparatus, a plurality of wager slips corresponding to a hybrid game such that each wager slip indicates a plurality of parallel matrices that each has a set of corresponding parallel matrix specific numbers. Further, at a process block 1104, the process 1100 generates, with a prize category display module, a display that indicates a first spot prize that is won by a player providing a wager and having a predetermined number of first spot matched parallel matrices. Each first spot matched parallel matrix has a match between a first spot quantity of numbers selected by the player from the set of corresponding parallel matrix specific numbers and a quantity of randomly drawn numbers from the set of corresponding parallel matrix specific numbers. In addition, at a process block 1106, the process generates, with the prize category display module, a display that indicates a second spot prize that is won by a player providing the wager and having a predetermined number of second spot matched parallel matrices. Each second spot matched parallel matrix has a match between a second spot quantity of numbers selected by the player from the set of corresponding parallel matrix specific numbers and a quantity of randomly drawn numbers from the set of corresponding parallel matrix specific numbers. The second spot quantity is greater than the first spot quantity, the second spot quantity prize corresponding to a quantity of matched parallel matrices being less than the first spot quantity prize corresponding to the quantity of matched matrices. At a process block 1108, the process 1100 also receives, from a player, a selection of a quantity of numbers corresponding to each parallel matrix generated on one of the plurality of wager slips, the quantity of numbers being based on the first spot quantity or the second spot quantity. Further, at a process block 1110, the process 1100 prints, with a hybrid ticket generation apparatus, a plurality of hybrid game tickets that are each based on player selections of numbers indicated on the plurality of wager slips. In addition, at a process block 1112, the process 1100 performs, with a random selection apparatus, a random selection in each of the parallel matrices of at least one winning number from the set of corresponding parallel matrix specific numbers. At a process block 1114, the process 1100 also provides a prize distribution to a player having a winning hybrid game ticket based on (i) spot quantity selected by the player and (ii) the predetermined number of matched parallel matrices.

Figure 12:
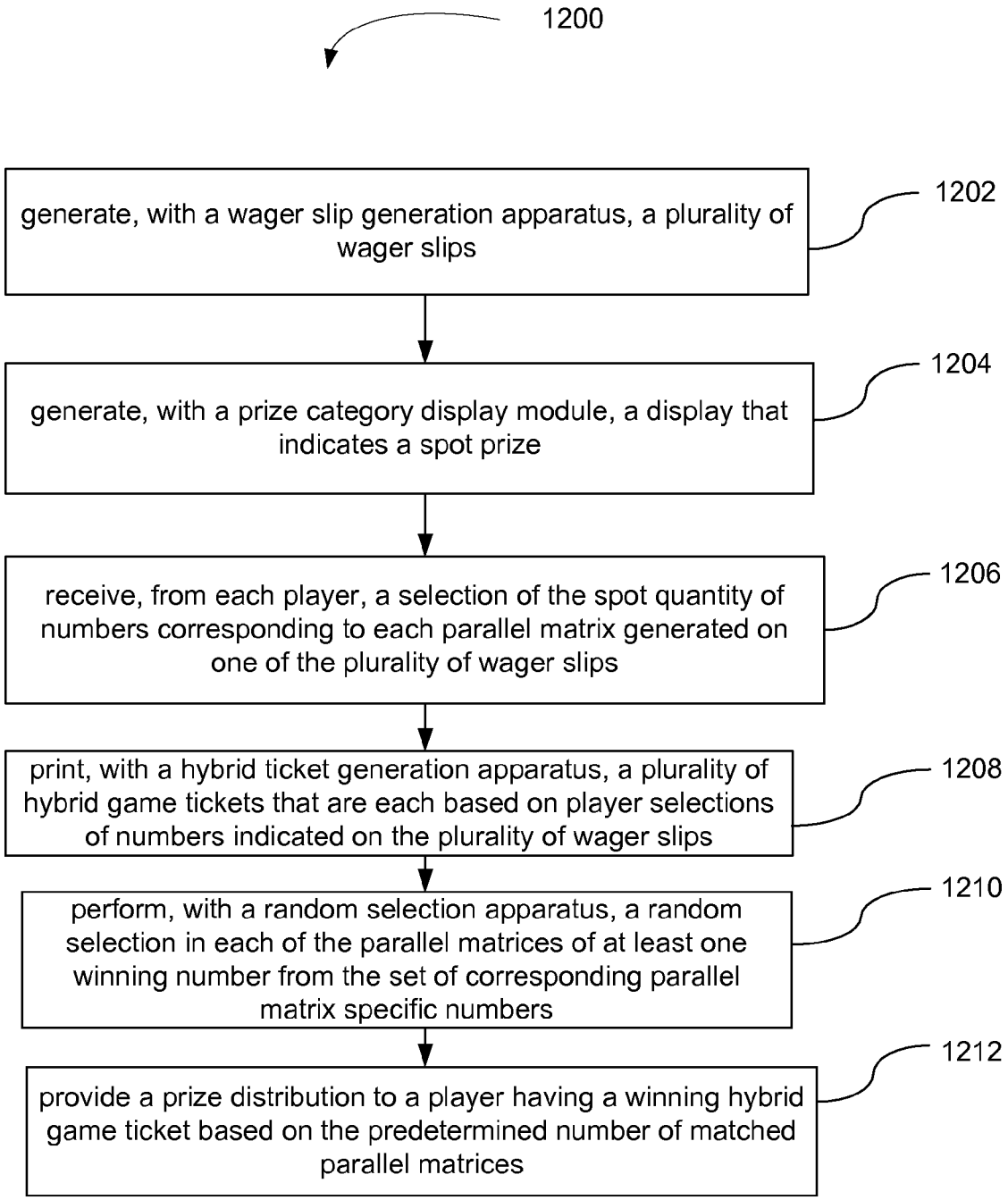
FIG. 12 illustrates another process that may be utilized to generate hybrid game tickets.

FIG. 12 illustrates another process 1200 that may be utilized to generate hybrid game tickets. At a process block 1202, the process 1200 generates, with a wager slip generation apparatus, a plurality of wager slips corresponding to a hybrid game such that each wager slip indicates a plurality of parallel matrices that each has a set of corresponding parallel matrix specific numbers. Further, at a process block 1204, the process 1200 generates, with a prize category display module, a display that indicates a spot prize that is won by a player having a predetermined number of matched parallel matrices. Each matched parallel matrix having a match between a spot quantity of numbers selected by the player from the set of corresponding parallel matrix specific numbers and a quantity of randomly drawn numbers from the set of corresponding parallel matrix specific numbers. In addition, at a process block 1206, the process 1200 receives, from each player, a selection of the spot quantity of numbers corresponding to each parallel matrix generated on one of the plurality of wager slips. At a process block 1208, the process 1200 also prints, with a hybrid ticket generation apparatus, a plurality of hybrid game tickets that are each based on player selections of numbers indicated on the plurality of wager slips. Further, at a process block 1210, the process 1200 performs, with a random selection apparatus, a random selection in each of the parallel matrices of at least one winning number from the set of corresponding parallel matrix specific numbers. In addition, at a process block 1212, the process 1200 provides a prize distribution to a player having a winning hybrid game ticket based on the predetermined number of matched parallel matrices.

FIG. 13 illustrates an expected payout table 1300. In one embodiment, a process of controlling and managing expected prize payout may be utilized to aggregate expected prize payouts across a plurality of wager amounts and a plurality of spot quantities to offer featured prize categories. The expected payout table 1300 is an example that is based on equal distribution of the alternatives illustrated in FIG. 13. The featured prize categories carry a higher expected payout than the maximum expected prize payout for the game as a whole. In one configuration, the featured prize may carry a higher expected payout that requires a maximum wager amount, which thereby increases the average wager amount in the hybrid game. The higher expected payout of featured prizes is offset against relatively lesser expected payout averages for minimum wager amounts and other spot quantity wagers that do not offer the featured or grand prize.

The expected payout table 1300 has a spot field 1302, a first wager field 1304, a second wager field 1306, and an average expected payout field 1308. The spot field 1302 has as examples a one spot 1310, a two spot 1312, a three spot 1314, and a four spot 1316. As examples, the first wager field 1304 may indicate a first wager of one dollar and the second wager field 1306 may indicate a second wager of two dollars. A first wager one spot expected payout 1318 may be fifty two percent and a second wager one spot expected payout 1326 may be fifty six percent to result in a one spot average expected payout 1334 of fifty four percent. Further, a first wager two spot expected payout 1320 may be forty eight percent and a second wager two spot expected payout 1328 may be fifty two percent to result in a two spot average expected payout 1336 of fifty percent. In addition, a first wager three spot expected payout 1322 may be forty seven percent and a second wager two spot expected payout 1330 may be forty nine percent to result in a three spot average expected payout 1338 of forty eight percent. Further, a first wager four spot expected payout 1324 may be forty seven percent and a second wager two spot expected payout 1332 may be forty nine percent to result in a four spot average expected payout 1340 of forty eight percent. The second wager one spot expected payout 1326 of fifty six percent is an example of the expected payout for a featured or grand prize.

The processes described herein may be implemented in a general, multi-purpose or single purpose processor. Such a processor will execute instructions, either at the assembly, compiled or machine-level, to perform the processes. Those instructions can be written by one of ordinary skill in the art following the description of the figures corresponding to the processes and stored or transmitted on a computer readable medium. The instructions may also be created using source code or any other known computer-aided design tool. A computer readable medium may be any medium capable of carrying those instructions and include a CD-ROM, DVD, magnetic or other optical disc, tape, silicon memory (e.g., removable, non-removable, volatile or non-volatile), packetized or non-packetized data through wireline or wireless transmissions locally or remotely through a network.

A computer is herein intended to include any device that has a general, multi-purpose or single purpose processor as described above. For example, a computer may be a lottery terminal, interactive television, a kiosk, a vending machine, a set top box ("STB"), cell phone, portable media player, or the like.

In any of the configurations provided herein, the payout for the prizes may be guaranteed by a third party entity. As a result, a lottery provider may be able to provide a larger lottery prize than might otherwise be the case. Further, any of the configurations provided herein may be utilized as a part of a stand alone lottery game, an add-on lottery game, or both. In addition, any of the configurations provided herein may have tickets with a retail bar code to allow retailers to account for the sale of every ticket.

Any of the configurations described herein may utilize a fixed prize, a variable prize, or both. The variable prize may be a progressive prize that increases based on ticket sales revenue or a portion thereof. The progressive prize may be a prize offered as the top prize or a secondary prize in a stand alone hybrid game.

Any of the configurations described herein may be utilized with an add-on progressive game. In one embodiment, the selection of price point in the hybrid game effects the percentage of the progressive prize that may be won with the add-on progressive game. For example, a wager of two dollars in the hybrid game may result in twenty percent of the progressive prize that may be won in the progressive game whereas a wager of ten dollars in the hybrid game may result in eighty percent of the progressive prize that may be won in the progressive game. Alternatively, the selection of the price point in the hybrid game may have no impact on the determination of the progressive game prize. For example, a progressive game winner that provided a wager of two dollars in the hybrid game may win the same amount of the progressive prize as a player that provided a wager of ten dollars in the hybrid game. The add-on progressive game may be a similar or different game to that of the hybrid game.

It is understood that the processes and systems described herein may also be applied in other types of processes and systems. Those skilled in the art will appreciate that the various adaptations and modifications of the embodiments of the processes and systems described herein may be configured without departing from the scope and spirit of the present processes and systems. Therefore, it is to be understood that, within the scope of the appended claims, the present processes and systems may be practiced other than as specifically described herein.

I claim:

1. A method comprising:

printing, with a wage slip printer, a plurality of wager slips corresponding to a hybrid game such that each wager slip indicates a plurality of columns that each has an identical set of corresponding column specific numbers that are sequential;

generating, with a prize category display module, a display that indicates a first spot low prize and a first spot high prize, the first spot low prize being won by a player providing a first wager and having a predetermined number of first spot matched columns, each first spot matched column having a match between a first spot quantity of numbers selected by the player from the set of corresponding column specific numbers and a quantity of randomly drawn numbers from the set of corresponding column specific numbers, the first spot high prize being won by a player providing a second wager and having the predetermined number of first spot matched columns, the second wager being greater than the first wager;

generating, with the prize category display module, a display that indicates a second spot low prize and a second spot high prize, the second spot low prize being won by a player providing a first wager and having a predetermined number of second spot matched columns, each second spot matched column having a match between a second spot quantity of numbers selected by the player from the set of corresponding column specific numbers and a quantity of randomly drawn numbers from the set of corresponding column specific numbers, the second spot high prize being won by a player providing a second wager and having the predetermined number of second spot matched columns, the second wager being greater than the first wager, the second spot high prize being less than the first spot high prize;

printing, with a hybrid ticket generation apparatus, a plurality of hybrid game tickets;

performing, with a random selection apparatus, a random selection in each of the columns of at least one winning number from the set of corresponding column specific numbers; and providing a prize distribution to a player having a winning hybrid game ticket.

2. The method of claim 1, wherein the second spot low prize is less than the first spot low prize.

3. The method of claim 1, wherein the hybrid game is a drawing game.

4. The method of claim 3, wherein the random selection of the plurality of numbers is a random drawing.

5. The method of claim 1, wherein the hybrid game is an instant game.

6. The method of claim 1, wherein each column has a corresponding column indicia.

7. The method of claim 1, wherein the first spot high prize and the second spot high prize are fixed prizes.

8. The method of claim 1, wherein the first spot low prize and the second spot low prize are pari-mutuel based prizes.

9. The method of claim 1, wherein the first spot high prize and the first spot low prize are fixed prizes, and the second spot high prize and the second spot low prize are pari-mutuel based prizes.

10. The method of claim 1, wherein the first spot high prize and the first spot low prize are pari-mutuel based prizes, and the second spot high prize and the second spot low prize are fixed prizes.

11. A computer program product comprising a tangible computer useable medium having a computer readable program, wherein the computer readable program when executed on a computer causes the computer to:

print, with a wage slip printer, a plurality of wager slips corresponding to a hybrid game such that each wager slip indicates a plurality of columns that each has an identical set of corresponding column specific numbers that are sequential;

generate, with a prize category display module, a display that indicates a first spot low prize and a first spot high prize, the first spot low prize being won by a player providing a first wager and having a predetermined number of first spot matched columns, each first spot matched column having a match between a first spot quantity of numbers selected by the player from the set of corresponding column specific numbers and a quantity of randomly drawn numbers from the set of corresponding column specific numbers, the first spot high prize being won by a player providing a second wager and having the predetermined number of first spot matched columns, the second wager being greater than the first wager;

generate, with the prize category display module, a display that indicates a second spot low prize and a second spot high prize, the second spot low prize being won by a player providing a first wager and having a predetermined number of second spot matched columns, each second spot matched column having a match between a second spot quantity of numbers selected by the player from the set of corresponding column specific numbers and a quantity of randomly drawn numbers from the set of corresponding column specific numbers, the second spot high prize being won by a player providing a second wager and having the predetermined number of second spot matched columns, the second wager being greater than the first wager, the second spot high prize being less than the first spot high prize;

print, with a hybrid ticket generation apparatus, a plurality of hybrid game tickets;

perform, with a random selection apparatus, a random selection in each of the columns of at least one winning number from the set of corresponding column specific numbers; and provide a prize distribution to a player having a winning hybrid game ticket based.

12. The computer program product of claim 11, wherein the second spot low prize is less than the first spot low prize.

13. The computer program product of claim 11, wherein the hybrid game is a drawing game.

14. The computer program product of claim 13, wherein the random selection of the plurality of numbers is a random drawing.

15. The computer program product of claim 11, wherein the hybrid game is an instant game.

16. The computer program product of claim 11, wherein each column has a corresponding column indicia.

17. The computer program product of claim 11, wherein the first spot high prize and the second spot high prize are fixed prizes.

18. The computer program product of claim 11, wherein the first spot low prize and the second spot low prize are pari-mutuel based prizes.

19. The computer program product of claim 1, wherein the first spot high prize and the first spot low prize are fixed prizes, and the second spot high prize and the second spot low prize are pari-mutuel based prizes.

20. The computer program product of claim 1, wherein the first spot high prize and the first spot low prize are pari-mutuel based prizes, and the second spot high prize and the second spot low prize are fixed prizes.

21. A system comprising:

a wage slip printer that prints a plurality of wager slips corresponding to a hybrid game such that each wager slip indicates a plurality of columns that each has an identical set of corresponding column specific numbers that are sequential;

a prize category display module that generates a display that indicates a first spot low prize, a first spot high prize, a second pot low prize, and a second spot high prize, the first spot low prize being won by a player providing a first wager and having a predetermined number of first spot matched columns, each first spot matched column having a match between a first spot quantity of numbers selected by the player from the set of corresponding column specific numbers and a quantity of randomly drawn numbers from the set of corresponding column specific numbers, the first spot high prize being won by a player providing a second wager and having the predetermined number of first spot matched columns, the second wager being greater than the first wager, the second spot low prize being won by a player providing a first wager and having a predetermined number of second spot matched columns, each second spot matched column having a match between a second spot quantity of numbers selected by the player from the set of corresponding column specific numbers and a quantity of randomly drawn numbers from the set of corresponding column specific numbers, the second spot high prize being won by a player providing a second wager and having the predetermined number of second spot matched columns, the second wager being greater than the first wager, the second spot high prize being less than the first spot high prize;

a hybrid game ticket printer that prints a plurality of hybrid game tickets;

a random selection module that performs, with a random selection apparatus, a random selection in each of the columns of at least one winning number from the set of corresponding column specific numbers; and a prize distribution module that provides a prize distribution to a player having a winning hybrid game ticket.

22. The system of claim 21, wherein the second spot low prize is less than the first spot low prize.

23. The system of claim 21, wherein the hybrid game is a drawing game.

24. The system of claim 23, wherein the random selection of the plurality of numbers is a random drawing.

25. The system of claim 21, wherein the hybrid game is an instant game.

26. The system of claim 21, wherein each column has a corresponding column indicia.

27. The system of claim 21, wherein the first spot high prize and the second spot high prize are fixed prizes.

28. The system of claim 21, wherein the first spot low prize and the second spot low prize are pari-mutuel based prizes.

29. The system of claim 21, wherein the first spot high prize and the first spot low prize are fixed prizes, and the second spot high prize and the second spot low prize are pari-mutuel based prizes.

30. The system of claim 21, wherein the first spot high prize and the first spot low prize are pari-mutuel based prizes, and the second spot high prize and the second spot low prize are fixed prizes.

31. A method comprising:

generating, with a wager slip generation apparatus, a plurality of wager slips corresponding to a hybrid game such that each wager slip indicates a plurality of parallel matrices that each has a set of corresponding parallel matrix specific numbers;

generating, with a prize category display module, a display that indicates a first spot low prize and a first spot high prize, the first spot low prize being won by a player providing a first wager and having a predetermined number of first spot matched parallel matrices, each first spot matched parallel matrix having a match between a first spot quantity of numbers selected by the player from the set of corresponding parallel matrix specific numbers and a quantity of randomly drawn numbers from the set of corresponding parallel matrix specific numbers, the first spot high prize being won by a player providing a second wager and having the predetermined number of first spot matched parallel matrices, the second wager being greater than the first wager;

generating, with the prize category display module, a display that indicates a second spot low prize and a second spot high prize, the second spot low prize being won by a player providing the first wager and having a predetermined number of second spot matched parallel matrices, each second spot matched column having a match between a second spot quantity of numbers selected by the player from the set of corresponding parallel matrix specific numbers and a quantity of randomly drawn numbers from the set of corresponding parallel matrix specific numbers, the second spot high prize being won by a player providing a second wager and having the predetermined number of second spot matched parallel matrices, the second wager being greater than the first wager, the second spot high prize being less than the first spot high prize;

printing, with a hybrid ticket generation apparatus, a plurality of hybrid game tickets;

performing, with a random selection apparatus, a random selection in each of the parallel matrices of at least one winning number from the set of corresponding parallel matrix specific numbers; and providing a prize distribution to a player having a winning hybrid game ticket.

32. The method of claim 31, wherein the second spot low prize is less than the first spot low prize.

33. The method of claim 31, wherein the hybrid game is a drawing game.

34. The method of claim 33, wherein the random selection of the plurality of numbers is a random drawing.

35. The method of claim 31, wherein the hybrid game is an instant game.

36. The method of claim 31, wherein at least a portion of the plurality of hybrid game tickets are electronic such that each of the plurality of hybrid game tickets appears on an electronic audio visual display.

37. The method of claim 31, wherein at least a portion of the plurality of hybrid game tickets are purchased online through a network.

38. The method of claim 31, wherein each of the plurality of parallel matrices is a column.

39. The method of claim 31, wherein each of the plurality of parallel matrices is a row.

40. The method of claim 31, wherein each of the plurality of parallel matrices is a diagonal.

41. The method of claim 31, wherein the set of numbers in each of the plurality of parallel matrices is identical.

42. The method of claim 41, wherein the set of numbers in each of the plurality of parallel matrices is sequential.

43. The method of claim 41, wherein the set of numbers in each of the plurality of parallel matrices is non-sequential.

44. The method of claim 31, wherein the set of numbers in each of the plurality of parallel matrices is distinct.

45. The method of claim 31, wherein each of the plurality of parallel matrices has a corresponding parallel matrix indicia.

46. The method of claim 31, wherein the first spot high prize and the second spot high prize are fixed prizes.

47. The method of claim 31, wherein the first spot low prize and the second spot low prize are pari-mutuel based prizes.

48. The method of claim 31, wherein the first spot high prize and the first spot low prize are fixed prizes, and the second spot high prize and the second spot low prize are pari-mutuel based prizes.

49. The method of claim 31, wherein the first spot high prize and the first spot low prize are pari-mutuel based prizes, and the second spot high prize and the second spot low prize are fixed prizes.

50. A computer program product comprising a tangible computer useable medium having a computer readable program, wherein the computer readable program when executed on a computer causes the computer to:

generate, with a wager slip generation apparatus, a plurality of wager slips corresponding to a hybrid game such that each wager slip indicates a plurality of parallel matrices that each has a set of corresponding parallel matrix specific numbers;

generate, with a prize category display module, a display that indicates a first spot low prize and a first spot high prize, the first spot low prize being won by a player providing a first wager and having a predetermined number of first spot matched parallel matrices, each first spot matched parallel matrix having a match between a first spot quantity of numbers selected by the player from the set of corresponding parallel matrix specific numbers and a quantity of randomly drawn numbers from the set of corresponding parallel matrix specific numbers, the first spot high prize being won by a player providing a second wager and having the predetermined number of first spot matched parallel matrices, the second wager being greater than the first wager;

generate, with the prize category display module, a display that indicates a second spot low prize and a second spot high prize, the second spot low prize being won by a player providing the first wager and having a predetermined number of second spot matched parallel matrices, each second spot matched column having a match between a second spot quantity of numbers selected by the player from the set of corresponding parallel matrix specific numbers and a quantity of randomly drawn numbers from the set of corresponding parallel matrix specific numbers, the second spot high prize being won by a player providing a second wager and having the predetermined number of second spot matched parallel matrices, the second wager being greater than the first wager, the second spot high prize being less than the first spot high prize;

print, with a hybrid ticket generation apparatus, a plurality of hybrid game tickets;

perform, with a random selection apparatus, a random selection in each of the parallel matrices of at least one winning number from the set of corresponding parallel matrix specific numbers; and provide a prize distribution to a player having a winning hybrid game ticket.

51. The computer program product of claim 50, wherein the second spot low prize is less than the first spot low prize.

52. The computer program product of claim 50, wherein the hybrid game is a drawing game.

53. The computer program product of claim 52, wherein the random selection of the plurality of numbers is a random drawing.

54. The computer program product of claim 50, wherein the hybrid game is an instant game.

55. The computer program product of claim 50, wherein at least a portion of the plurality of hybrid game tickets are electronic such that each of the plurality of hybrid game tickets appears on an electronic audio visual display.

56. The computer program product of claim 50, wherein at least a portion of the plurality of hybrid game tickets are purchased online through a network.

57. The computer program product of claim 50, wherein each of the plurality of parallel matrices is a column.

58. The computer program product of claim 50, wherein each of the plurality of parallel matrices is a column.

59. The computer program product of claim 50, wherein each of the plurality of parallel matrices is a diagonal.

60. The computer program product of claim 50, wherein the set of numbers in each of the plurality of parallel matrices is identical.

61. The computer program product of claim 60, wherein the set of numbers in each of the plurality of parallel matrices is sequential.

62. The computer program product of claim 60, wherein the set of numbers in each of the plurality of parallel matrices is non-sequential.

63. The computer program product of claim 50, wherein the set of numbers in each of the plurality of parallel matrices is distinct.

64. The computer program product of claim 50, wherein each of the plurality of parallel matrices has a corresponding parallel matrix indicia.

65. The computer program product of claim 50, wherein the first spot high prize and the second spot high prize are fixed prizes.

66. The computer program product of claim 50, wherein the first spot low prize and the second spot low prize are pari-mutuel based prizes.

67. The computer program product of claim 50, wherein the first spot high prize and the first spot low prize are fixed prizes, and the second spot high prize and the second spot low prize are pari-mutuel based prizes.

68. The computer program product of claim 50, wherein the first spot high prize and the first spot low prize are pari-mutuel based prizes, and the second spot high prize and the second spot low prize are fixed prizes.

69. A system comprising:

a wage slip generation apparatus that generates a plurality of wager slips corresponding to a hybrid game such that each wager slip indicates a plurality of parallel matrices that each has a set of corresponding parallel matrix specific numbers;

a prize category display module that generates a display that indicates a first spot low prize, a first spot high prize, a second spot low prize, and a second spot high prize, the first spot low prize being won by a player providing a first wager and having a predetermined number of first spot matched parallel matrices, each first spot matched parallel matrix having a match between a first spot quantity of numbers selected by the player from the set of corresponding parallel matrix specific numbers and a quantity of randomly drawn numbers from the set of corresponding parallel matrix specific numbers, the first spot high prize being won by a player providing a second wager and having the predetermined number of first spot matched parallel matrices, the second wager being greater than the first wager, the second spot low prize being won by a player providing the first wager and having a predetermined number of second spot matched parallel matrices, each second spot matched column having a match between a second spot quantity of numbers selected by the player from the set of corresponding parallel matrix specific numbers and a quantity of randomly drawn numbers from the set of corresponding parallel matrix specific numbers, the second spot high prize being won by a player providing a second wager and having the predetermined number of second spot matched parallel matrices, the second wager being greater than the first wager, the second spot high prize being less than the first spot high prize;

a hybrid game ticket printer that prints, with a hybrid ticket generation apparatus, a plurality of hybrid game tickets;

a random selection apparatus that performs a random selection in each of the parallel matrices of at least one winning number from the set of corresponding parallel matrix specific numbers; and a prize distribution that provides a prize distribution to a player having a winning hybrid game ticket.

70. The system of claim 69, wherein the second spot low prize is less than the first spot low prize.

71. The system of claim 69, wherein the hybrid game is a drawing game.

72. The system of claim 71, wherein the random selection of the plurality of numbers is a random drawing.

73. The system of claim 69, wherein the hybrid game is an instant game.

74. The system of claim 69, wherein at least a portion of the plurality of hybrid game tickets are electronic such that each of the plurality of hybrid game tickets appears on an electronic audio visual display.

75. The system of claim 69, wherein at least a portion of the plurality of hybrid game tickets are purchased online through a network.

76. The system of claim 69, wherein each of the plurality of parallel matrices is a column.

77. The system of claim 69, wherein each of the plurality of parallel matrices is a row.

78. The system of claim 69, wherein each of the plurality of parallel matrices is a diagonal.

79. The system of claim 69, wherein the set of numbers in each of the plurality of parallel matrices is identical.

80. The system of claim 79, wherein the set of numbers in each of the plurality of parallel matrices is sequential.

81. The system of claim 79, wherein the set of numbers in each of the plurality of parallel matrices is non-sequential.

82. The system of claim 69, wherein the set of numbers in each of the plurality of parallel matrices is distinct.

83. The system of claim 69, wherein each of the plurality of parallel matrices has a corresponding parallel matrix indicia.

84. The system of claim 69, wherein the first spot high prize and the second spot high prize are fixed prizes.

85. The system of claim 69, wherein the first spot low prize and the second spot low prize are pari-mutuel based prizes.

86. The system of claim 69, wherein the first spot high prize and the first spot low prize are fixed prizes, and the second spot high prize and the second spot low prize are pari-mutuel based prizes.

87. The system of claim 69, wherein the first spot high prize and the first spot low prize are pari-mutuel based prizes, and the second spot high prize and the second spot low prize are fixed prizes.

88. A method comprising:

generating, with a wager slip generation apparatus, a plurality of wager slips corresponding to a hybrid game such that each wager slip indicates a plurality of parallel matrices that each has a set of corresponding parallel matrix specific numbers;

generating, with a prize category display module, a display that indicates a first spot prize that is won by a player providing a wager and having a predetermined number of first spot matched parallel matrices, each first spot matched parallel matrix having a match between a first spot quantity of numbers selected by the player from the set of corresponding parallel matrix specific numbers and a quantity of randomly drawn numbers from the set of corresponding parallel matrix specific numbers;

generating, with the prize category display module, a display that indicates a second spot prize that is won by a player providing the wager and having a predetermined number of second spot matched parallel matrices, each second spot matched parallel matrix having a match between a second spot quantity of numbers selected by the player from the set of corresponding parallel matrix specific numbers and a quantity of randomly drawn numbers from the set of corresponding parallel matrix specific numbers, the second spot quantity being greater than the first spot quantity, the second spot quantity prize corresponding to a quantity of matched parallel matrices being less than the first spot quantity prize corresponding to the quantity of matched matrices;

printing, with a hybrid ticket generation apparatus, a plurality of hybrid game tickets;

performing, with a random selection apparatus, a random selection in each of the parallel matrices of at least one winning number from the set of corresponding parallel matrix specific numbers; and providing a prize distribution to a player having a winning hybrid game ticket.

89. A computer program product comprising a tangible computer useable medium having a computer readable program, wherein the computer readable program when executed on a computer causes the computer to:

generate, with a wager slip generation apparatus, a plurality of wager slips corresponding to a hybrid game such that each wager slip indicates a plurality of parallel matrices that each has a set of corresponding parallel matrix specific numbers;

generate, with a prize category display module, a display that indicates a first spot prize that is won by a player providing a wager and having a predetermined number of first spot matched parallel matrices, each first spot matched parallel matrix having a match between a first spot quantity of numbers selected by the player from the set of corresponding parallel matrix specific numbers and a quantity of randomly drawn numbers from the set of corresponding parallel matrix specific numbers;

generate, with the prize category display module, a display that indicates a second spot prize that is won by a player providing the wager and having a predetermined number of second spot matched parallel matrices, each second spot matched parallel matrix having a match between a second spot quantity of numbers elected by the player from the set of corresponding parallel matrix specific numbers and a quantity of randomly drawn numbers from the set of corresponding parallel matrix specific numbers, the second spot quantity being greater than the first spot quantity, the second spot quantity prize corresponding to a quantity of matched parallel matrices being less than the first spot quantity prize corresponding to the quantity of matched matrices;

print, with a hybrid ticket generation apparatus, a plurality of hybrid game tickets;

perform, with a random selection apparatus, a random selection in each of the parallel matrices of at least one winning number from the set of corresponding parallel matrix specific numbers; and provide a prize distribution to a player having a winning hybrid game ticket.

90. A system comprising:

a wage slip generation apparatus that generates a plurality of wager slips corresponding to a hybrid game such that each wager slip indicates a plurality of parallel matrices that each has a set of corresponding parallel matrix specific numbers;

a prize category display module that generates a display that indicates a first spot prize and a second spot prize, the first spot prize being won by a player providing a wager and having a predetermined number of first spot matched parallel matrices, each first spot matched parallel matrix having a match between a first spot quantity of numbers selected by the player from the set of corresponding parallel matrix specific numbers and a quantity of randomly drawn numbers from the set of corresponding parallel matrix specific numbers, the second spot prize being won by a player providing the wager and having a predetermined number of second spot matched parallel matrices, each second spot matched parallel matrix having a match between a second spot quantity of numbers elected by the player from the set of corresponding parallel matrix specific numbers and a quantity of randomly drawn numbers from the set of corresponding parallel matrix specific numbers, the second spot quantity being greater than the first spot quantity, the second spot quantity prize corresponding to a quantity of matched parallel matrices being less than the first spot quantity prize corresponding to the quantity of matched matrices;

a hybrid game ticket printer that prints a plurality of hybrid game tickets;

a random selection apparatus that performs a random selection in each of the parallel matrices of at least one winning number from the set of corresponding parallel matrix specific numbers; and a prize distribution that provides a prize distribution to a player having a winning hybrid game ticket.

* * * * *